US009120323B2

(12) United States Patent
Tanaka et al.

(10) Patent No.: US 9,120,323 B2
(45) Date of Patent: Sep. 1, 2015

(54) LIQUID DROPLET EJECTING APPARATUS

(71) Applicant: FUJIFILM CORPORATION, Minato-ku, Tokyo (JP)

(72) Inventors: Kumiko Tanaka, Kanagawa (JP); Masaki Kataoka, Kanagawa (JP); Yoshihira Rai, Kanagawa (JP); Hiroshi Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/626,926

(22) Filed: Feb. 20, 2015

(65) Prior Publication Data

US 2015/0165784 A1 Jun. 18, 2015

Related U.S. Application Data

(63) Continuation of application No. PCT/JP2013/072208, filed on Aug. 20, 2013.

(30) Foreign Application Priority Data

Sep. 6, 2012 (JP) ..... 2012-196481

(51) Int. Cl.
*B41J 29/377* (2006.01)
*B41J 2/045* (2006.01)
*B41J 2/19* (2006.01)

(52) U.S. Cl.
CPC ..... *B41J 2/19* (2013.01)

(58) Field of Classification Search
CPC ..... B41J 2/17503; B41J 2/375; B41J 2/3358; B41J 29/023
USPC ..... 347/17, 18, 19, 20, 54, 68
See application file for complete search history.

(56) References Cited

U.S. PATENT DOCUMENTS 5,340,081 A * 8/1994 Wright ..... 251/129.06
5,354,032 A * 10/1994 Sims et al. ..... 251/129.06
5,628,411 A * 5/1997 Mills et al. ..... 209/644
8,292,396 B2 * 10/2012 Yamada ..... 347/17

FOREIGN PATENT DOCUMENTS

JP 2004-322605 A 11/2004
JP 2006-248078 A 9/2006

* cited by examiner

*Primary Examiner* — Anh T. N. Vo
(74) *Attorney, Agent, or Firm* — Solaris Intellectual Property Group, PLLC

(57) ABSTRACT

The present invention provides a liquid droplet ejecting apparatus that may cool, with a simple configuration, drive sections of piezoelectric elements. Namely, the liquid droplet ejecting apparatus has head modules that use piezoelectric elements to eject ink droplets, driver ICs that drive the piezoelectric elements, a ventilation unit that delivers dry air to the environs of the piezoelectric elements via a gas delivery passage disposed therein in order to dehumidify the environs of the piezoelectric elements, a branch tube that branches from the gas delivery passage and blows onto the driver ICs some of the air that has been delivered, and a duckbill valve that is disposed in the branch tube. Here, the ventilation unit that delivers the dry air in order to dehumidify the environs of the piezoelectric elements also cools the driver ICs, so the driver ICs can be cooled with a simple configuration.

6 Claims, 23 Drawing Sheets

LIQUID DROPLET EJECTING APPARATUS

CROSS-REFERENCE TO RELATED APPLICATIONS

This application is a continuation application of International Application No. PCT/JP2013/072208, filed Aug. 20, 2013, the disclosure of which is incorporated herein by reference in its entirety. Further, this application claims priority from Japanese Patent Application No. 2012-196481, filed Sep. 6, 2012, the disclosure of which is incorporated herein by reference in its entirety.

BACKGROUND OF THE INVENTION

1. Field of the Invention

The present invention relates to a liquid droplet ejecting apparatus.

2. Description of the Related Art

The liquid droplet ejecting apparatus of Japanese Patent Application Laid-open (JP-A) No. 2006-248078 has a hollow-fiber membrane air dryer that comprises numerous hollow-fiber membranes and is disposed inside a case that covers piezoelectric elements. In the liquid droplet ejecting apparatus of JP-A No. 2006-248078, compressed air from a compressor travels through the insides of the hollow-fiber membranes and is expelled inside the case as dry air from the other ends of the hollow-fiber membranes.

The inkjet recording apparatus of JP-A No. 2004-322605 has pressure chambers filled with ink liquid, nozzle holes formed in the pressure chambers, piezoelectric elements that are formed over the pressure chambers and undergo mechanical expansion and contraction to thereby deform the pressure chambers and eject ink from the nozzle holes, and dew point control section that keeps the dew point of the piezoelectric elements at a value lower than the dew point of the environment in which the inkjet recording apparatus is installed. The dew point control section comprises a compressor and an air dryer that dries compressed gas from the compressor and delivers the compressed gas to the piezoelectric elements.

SUMMARY OF THE INVENTION

The present invention provides a liquid droplet ejecting apparatus that can cool, with a simple configuration, drive sections of piezoelectric elements in a configuration that delivers air to the piezoelectric elements.

A first aspect of the present invention is a liquid droplet ejecting section that ejects liquid droplets by pressurizing a liquid using a piezoelectric element; a drive section that drives the piezoelectric element; a gas delivery section that delivers a dry gas; a gas delivery passage in which the piezoelectric element is disposed and through which the gas that has been delivered from the gas delivery section flows; a branch passage, disposed with its side opposite the gas delivery passage side facing the drive section, that branches from the gas delivery passage and blows onto the drive section some of the gas that has been delivered from the gas delivery section; and a cutoff section, provided in the branch passage, that allows the gas to be delivered from the gas delivery passage to the branch passage, and that cuts off the flow of the gas from the branch passage to the gas delivery passage.

In a second aspect of the present invention, in the first aspect, the cutoff section is a one-way valve that is urged in a closing direction and is opened by a difference in pressure between the gas delivery passage and the branch passage in a case in which the gas delivery section starts gas delivery.

In a third aspect of the present invention, in the above-described aspects, one end and the other end of the gas delivery passage are connected to the gas delivery section, and the branch passage is configured such that the gas reaches from the one end to the other end of the gas delivery passage.

In a fourth aspect of the present invention, in the third aspect, a detecting section that detects the flow amount of the gas is provided in the gas delivery passage at the downstream side than the branch passage, and the gas delivery section delivers the gas such that the flow amount of the gas that has been detected by the detecting section becomes equal to or greater than a set amount.

In a fifth aspect of the present invention, in the above-described aspects, the branch passage branches from the gas delivery passage at the downstream side than the piezoelectric element.

In a sixth aspect of the present invention, in the above-described aspects, plural liquid droplet ejecting sections and the drive sections are provided, and a regulating member that regulates outflow of the gas that is delivered to the drive sections is provided between one drive section and the other drive section.

In the first aspect of the present invention, in a configuration that delivers a dry gas to the environs of the piezoelectric elements, the drive sections of the piezoelectric element may be cooled with a simple configuration, compared to a configuration that cools the drive sections using different elements from an gas delivery section that delivers a dry gas to the environs of the piezoelectric elements.

In the second aspect of the present invention, backflow of the air may be suppressed with a simple configuration compared to a configuration where the cutoff section is a control valve.

In the third aspect of the present invention, the gas may be more reliably supplied to all of the piezoelectric elements compared to a configuration where the gas does not reach from one end to the other end of the gas delivery passage because of the branch passage.

In the fourth aspect of the present invention, the state of gas delivery to the piezoelectric elements may be managed compared to a configuration that does detect the flow amount of the gas.

In the fifth aspect of the present invention, the gas may be more reliably delivered to the piezoelectric elements compared to a configuration where the branch passage is connected to the gas delivery passage on the upstream side of the piezoelectric elements.

In the sixth aspect of the present invention, the efficiency with which the drive sections are cooled may be improved compared to a configuration where the space between the one drive section and the other drive section is open.

BRIEF DESCRIPTION OF DRAWINGS

Detailed explanation follows regarding exemplary embodiments of the present invention, with reference to the following drawings.

DESCRIPTION OF EMBODIMENTS

First Exemplary Embodiment

An example of a liquid droplet ejecting apparatus pertaining to a first exemplary embodiment of the present invention will be described.

Figure 1:
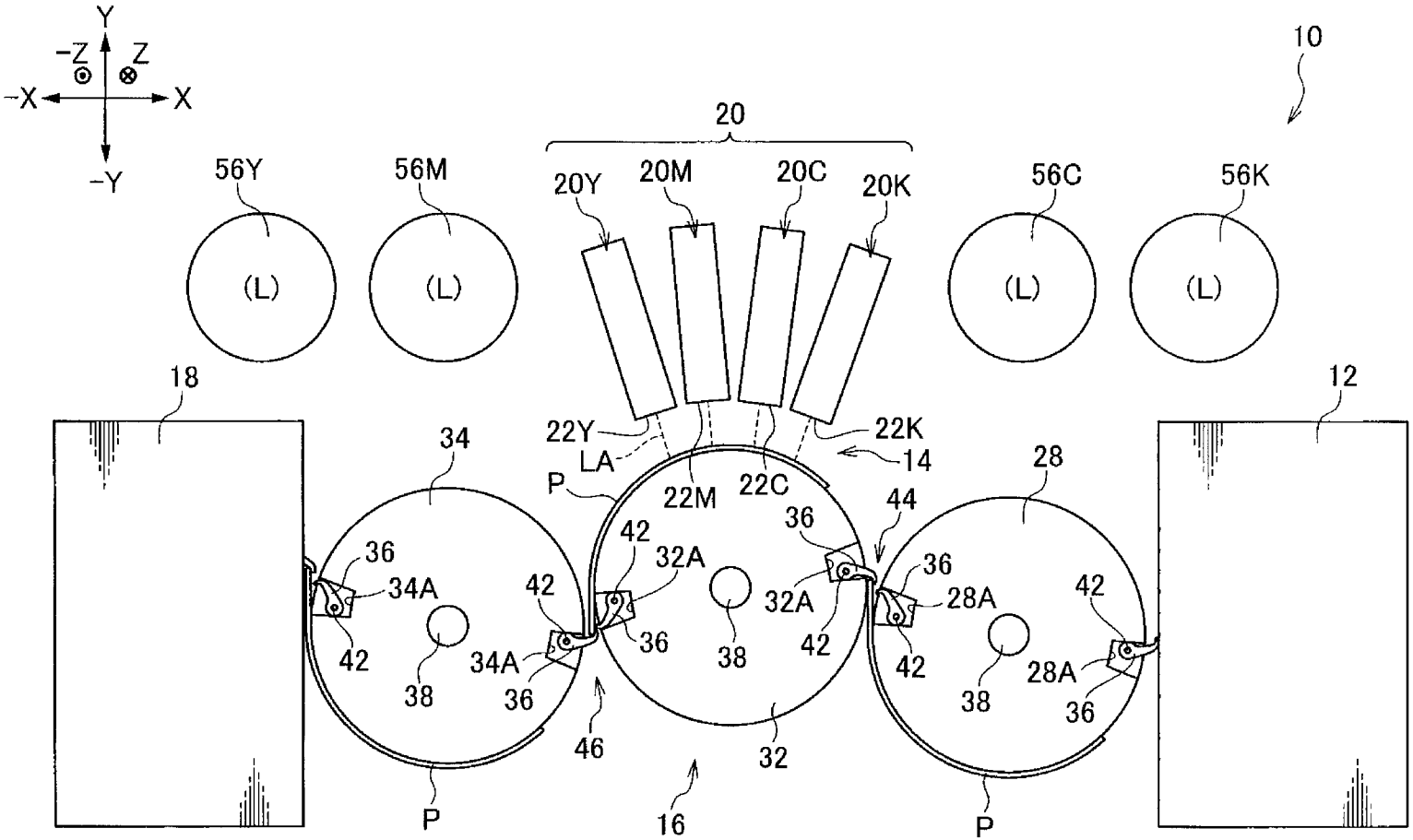
FIG. 1 is a schematic diagram showing the configuration of an inkjet recording apparatus pertaining to a first exemplary embodiment.

In FIG. 1, there is shown an inkjet recording apparatus 10 serving as an example of a liquid droplet ejecting apparatus that records an image on a recording medium P by ejecting ink droplets LA serving as an example of liquid droplets. The inkjet recording apparatus 10 is configured to include a housing section 12, an image recording section 14, conveying section 16, and a discharge section 18. The recording medium P is accommodated in the housing section 12. The image recording section 14 records an image on the recording medium P. The conveying section 16 conveys the recording medium P from the housing section 12 to the image recording section 14. The recording medium P on which the image has been recorded by the image recording section 14 is discharged to the discharge section 18.

The image recording section 14 has inkjet heads 20Y, 20M, 20C, and 20K. Furthermore, each of the inkjet heads 20Y, 20M, 20C, and 20K has plural nozzles 24 (see FIG. 2). Additionally, nozzle surfaces 22Y, 22M, 22C, and 22K in which the nozzles 24 are disposed each have a recordable region equal to or greater than the maximum width of the recording medium P.

Moreover, the inkjet heads 20Y, 20M, 20C, and 20K are arranged in parallel in the order of the colors of yellow (Y), magenta (M), cyan (C), and black (K) from the downstream side of the conveyance direction of the recording medium P. The inkjet heads 20Y, 20M, 20C, and 20K use piezoelectricity to eject ink droplets LA corresponding to the respective colors from the plural nozzles 24 (see FIG. 2) to thereby record an image on the recording medium P. In the description hereinafter, Y, M, C, and K will be added to reference signs in cases where it is necessary to distinguish between the colors of ink. Furthermore, sometimes Y, M, C, and K will be omitted in cases where it is not necessary to distinguish between the colors of ink.

In the inkjet recording apparatus 10, main tanks 56 serving as storage portion that store ink L serving as an example of a liquid are disposed for each color. The main tanks 56Y, 56M, 56C, and 56K of each color supply the ink L to the inkjet heads 20Y, 20M, 20C, and 20K. Various types of ink, such as water-based ink, oil-based ink, and solvent ink, can be used as the ink L supplied to the inkjet heads 20Y, 20M, 20C, and 20K.

The conveying section 16 has an extraction drum 28, a conveyance drum 32, and an out-feed drum 34. The extraction drum 28 extracts, one sheet at a time, the recording medium P inside the housing section 12. The conveyance drum 32 conveys the recording medium P to the inkjet heads 20Y, 20M, 20C, and 20K of the image recording section 14 and causes a recording surface (front surface) of the recording medium P to face the inkjet heads 20Y, 20M, 20C, and 20K. The out-feed drum 34 feeds out the recording medium P on which the image has been recorded to the discharge section 18. Additionally, the extraction drum 28, the conveyance drum 32, and the out-feed drum 34 are configured to use electrostatic holding section or non-electrostatic holding section such as suction or pressure-sensitive adhesion to hold the recording medium P on their outer peripheral surfaces.

Furthermore, in each of the extraction drum 28, the conveyance drum 32, and the out-feed drum 34, grippers 36 that grip and hold the conveyance direction downstream side end portion of the recording medium P are disposed two sets apiece an interval apart from one another in the circumferential direction. The extraction drum 28, the conveyance drum 32, and the out-feed drum 34 are configured in such a way that they can each hold up to two sheets of the recording medium P on their outer peripheral surfaces using the grippers 36. The grippers 36 are disposed inside recessed portions 28A, 32A, and 34A formed two apiece in each of the outer peripheral surfaces of the extraction drum 28, the conveyance drum 32, and the out-feed drum 34.

Specifically, rotating shafts 42 running parallel to rotating shafts 38 of the extraction drum 28, the conveyance drum 32, and the out-feed drum 34 are supported in predetermined positions inside the recessed portions 28A, 32A, and 34A. The plural grippers 36 are disposed an interval apart from one another in the axial direction of the rotating shafts 42 on the rotating shafts 42. Consequently, in a case in which the rotating shafts 42 are rotated in a forward direction (e.g., the clockwise direction in the drawing) or a reverse direction (e.g., the counter-clockwise direction in the drawing) by actuators (not shown in the drawings), the rotating shafts 42 rotate in the forward direction or the reverse direction along the circumferential direction of the extraction drum 28, the conveyance drum 32, and the out-feed drum 34. At this case, the grippers 36 grip and hold or release the conveyance direction downstream side end portion of the recording medium P.

Namely, the grippers 36 rotate in such a way that their distal end portions project a little from the outer peripheral surfaces of the extraction drum 28, the conveyance drum 32, and the out-feed drum 34, so that the grippers 36 transfer the recording medium P from the grippers 36 of the extraction drum 28 to the grippers 36 of the conveyance drum 36 at a transfer position 44 where the outer peripheral surface of the extraction drum 28 and the outer peripheral surface of the conveyance drum 32 face one another. Moreover, the grippers 36 transfer the recording medium P from the grippers 36 of the conveyance drum 32 to the grippers 36 of the out-feed drum 34 at a transfer position 46 where the outer peripheral surface of the conveyance drum 32 and the outer peripheral surface of the out-feed drum 34 face one another.

Furthermore, the inkjet recording apparatus 10 is equipped with maintenance units (not shown in the drawings) that maintain the inkjet heads 20Y, 20M, 20C, and 20K. The maintenance units have caps, receiving members, cleaning members, and suction devices. The caps cover the nozzle surfaces 22Y, 22M, 22C, and 22K of the inkjet heads 20Y, 20M, 20C, and 20K. The receiving members receive ink droplets LA that have been spit (dummy jetted). The cleaning members clean the nozzle surfaces 22Y, 22M, 22C, and 22K, and the suction devices suck the ink inside the nozzles. Additionally, in a case in which the maintenance units move to opposing positions where they oppose the inkjet heads 20Y, 20M, 20C, and 20K, various maintenance operations are performed.

Here, in FIG. 1, looking at the inkjet recording apparatus 10 from the axial direction of the rotating shafts 38, the direction heading from the discharge section 18 to the housing section 12 is an X direction (a right direction in the drawing), the illustrated upward direction orthogonal to the X direction is a Y direction, and the illustrated depth direction orthogonal to the X direction is a Z direction. Furthermore, the opposite directions of the X, Y, and Z directions are −X, −Y, and −Z directions. The symbol made up of a circle with an "x" inside in the drawing denotes the Z direction (the depth direction), and the symbol made up of a circle with a dot inside denotes the −Z direction.

Next, the image recording operations of the inkjet recording apparatus 10 will be described.

The recording medium P that has been extracted one sheet at a time from the housing section 12 by the grippers 36 of the extraction drum 28 and held on the outer peripheral surface of the extraction drum 28 is conveyed while being held on the outer peripheral surface of the extraction drum 28. The recording medium P is transferred at the transfer position 44 from the grippers 36 of the extraction drum 28 to the grippers 36 of the conveyance drum 32. Furthermore, the recording medium P held by the grippers 36 of the conveyance drum 32 is conveyed to an image recording position of the inkjet heads 20Y, 20M, 20C, and 20K while being held on the outer peripheral surface of the conveyance drum 32, and an image is recorded on the recording surface of the recording medium P by ink droplets LA ejected from the inkjet heads 20Y, 20M, 20C, and 20K.

Next, the recording medium P on whose recording surface the image has been recorded is transferred at the transfer position 46 from the grippers 36 of the conveyance drum 32 to the grippers 36 of the out-feed drum 34. Then, the recording medium P held by the grippers 36 of the out-feed drum 34 is conveyed while being held on the outer peripheral surface of the out-feed drum 34 and is discharged to the discharge section 18. In this way, the series of image recording operations is performed.

Next, the configuration of each part of the inkjet recording apparatus 10 will be described.

Figure 2:
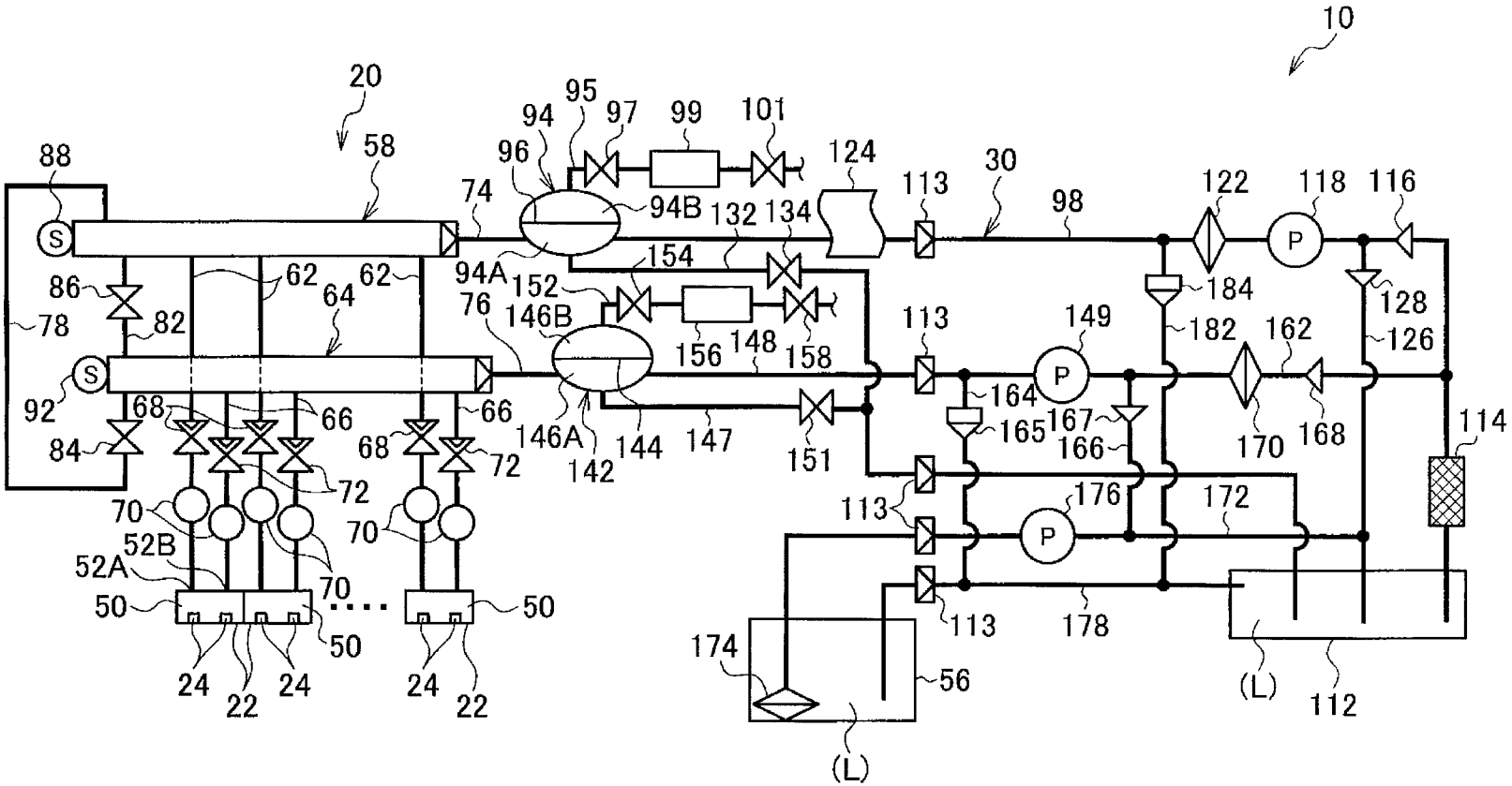
FIG. 2 is a piping diagram of an inkjet head pertaining to the first exemplary embodiment.

In FIG. 2, there is shown a piping diagram from the main tank 56 that stores the ink L to the inkjet head 20. The inkjet recording apparatus 10 is configured to include the main tank 56 that stores the ink L, plural head modules 50, and a supply passage 30. The plural head modules 50 are an example of liquid droplet ejecting sections that use piezoelectric elements 63 (see FIG. 3) to pressurize the ink L and eject ink droplets LA (see FIG. 1). The ink L that is supplied to the head modules 50 flows in the supply passage 30 (the ink L flows from the main tank 56 to each of the head modules 50). Furthermore, as was already mentioned, the plural nozzles 24 from which the ink droplets LA (see FIG. 1) are ejected are formed in each of the head modules 50. The supply passage 30 is configured to include a supply side main tube 98, a supply tube 74, and supply side branch passages 62 described later.

Each of the head modules 50 is disposed with an input port 52A into which the ink L flows and an output port 52B from which the ink L is expelled. Distal ends of the supply side branch passages 62, which branch from a supply side manifold 58, are attached to the input ports 52A. Furthermore, distal ends of recovery side branch passages 66, which branch from a recovery side manifold 64, are attached to the output ports 52B.

Namely, branch tubes (the supply side branch passages 62 and the recovery side branch passages 66) equal in number to the number of the head modules 50 that are installed are disposed in the supply side manifold 58 and the recovery side manifold 64. Additionally, the inkjet recording apparatus 10 supplies the ink L that is supplied to the supply side manifold 58 to each of the head modules 50 at a predetermined pressure (P1) and a predetermined flow amount. Moreover, the inkjet recording apparatus 10 recovers the ink L that has been supplied to the head modules 50 from each of the head modules 50 to the recovery side manifold 64 at a predetermined pressure (P2) and a predetermined flow amount.

Here, inside the head modules 50, a difference in pressure $\Delta P$ (=P1−P2) is generated between the pressure P1 on the supply side and the pressure P2 on the recovery side, so that a back pressure P3 (P3=(P1+P2)/2) that is the average pressure of the sum of the pressure P1 and the pressure P2 is applied to the nozzle surfaces 22. Accordingly back pressure P3, the ink L is held in the plural nozzles 24 of the head modules 50. In a case in which later-described piezoelectric elements 63 (see FIG. 3) for the purpose of ejecting the ink L are driven, ejecting of the ink L corresponding to image information is executed. The pressures P1 and P2 and the back pressure P3 are not shown in the drawings.

Supply side valves 68 and dampers 70 are disposed in the supply side branch passages 62. Furthermore, recovery side valves 72 and dampers 70 are disposed in the recovery side branch passages 66. The supply side valves 68 and the recovery side valves 72 are opened and closed in a case in which it is necessary to individually operate the head modules 50. The dampers 70 reduces pressure fluctuations and so forth at cases in which the ink L that is supplied from the supply side manifold 58 and the ink L that is recovered to the recovery side manifold 64 flow.

One end of the supply tube 74, which configures part of the supply passage 30, is attached to one lengthwise direction end (the right end portion in FIG. 2) of the supply side manifold 58. One end of a recovery tube 76, which configures part of a tube system for circulating the ink L, is attached to one lengthwise direction end (the right end portion in FIG. 2) of the recovery side manifold 64. Furthermore, a first flow passage 78 and a second flow passage 82 are disposed between the other end of the supply side manifold 58 and the other end of the recovery side manifold 64.

A first valve 84 is disposed in the first flow passage 78. Furthermore, a second valve 86 is disposed in the second flow passage 82. The first flow passage 78 and the second flow passage 82 are used to adjust the pressure between the supply side manifold 58 and the recovery side manifold 64 and to adjust the flow amount of the ink L. For example, during normal circulation of the ink L (a flow of the ink L from the supply side manifold 58 to the recovery side manifold 64), the first valve 84 is closed and the second valve 68 is opened so that the ink L can circulate only in the second flow passage 82.

Moreover, a supply side pressure sensor 88 and a recovery side pressure sensor 92 are attached to the other end of the supply side manifold 58 and the other end of the recovery side manifold 64, respectively. The supply side pressure sensor 88 and the recovery side pressure sensor 92 monitor the pressure of the ink L flowing inside the supply side manifold 58 and the recovery side manifold 64.

Furthermore, the other end of the supply tube 74 coupled to the supply side manifold 58 is coupled to a supply side sub-tank 94. The supply side sub-tank 94 has a two chamber structure where its inside is partitioned by a membrane member 96 having elastic force, so that the lower side is an ink sub-tank chamber 94A and the upper side is an air chamber 94B. One end of the supply side main tube 98 for drawing in the ink L from a buffer tank 112 coupled to the main tank 56 is coupled to the ink sub-tank chamber 94A. The other end of the supply side main tube 98 is coupled to the buffer tank 112. An open tube 95 is coupled to the air chamber 94B, and a supply side air connect valve 97, a supply side air tank 99, and a supply side air valve 101 are disposed in the open tube 95.

A degassing module 114, an one-way valve 116, a supply side pump 118, a supply side filter 122, and an ink temperature regulator 124 are disposed in this order, from the buffer tank 112 to the supply side sub-tank 94, in the supply side main tube 98. The supply side pump 118 is an example of supplying section that pressurizes and supplies the ink L to the head modules 50 via the supply passage 30. The ink temperature regulator 124 has, for example, a heater and a fan (not shown in the drawings) and uses the heater to heat the ink L and uses the fan to cool the ink L.

The degassing module 114 is, for example, configured to include a tube (not shown in the drawings) having a two layer structure, and this tube is formed by a membrane that allows only gas molecules to pass through. Furthermore, a vacuum pump (not shown in the drawings) having a negative pressure changing function is connected to the degassing module 114. When the vacuum pump operates, the inside of the degassing module 114 is depressurized to degas the ink L. The ink temperature regulator 124 and the degassing module 114 remove air bubbles from the ink L and manage the temperature of the ink L as the ink L stored in the buffer tank 112 is supplied to the supply side sub-tank 94 by the driving force of the supply side pump 118.

One end of a branch tube 126 is coupled, separately from the supply side main tube 98, to an inlet side of the supply side pump 118. The other end of the branch tube 126 is coupled to the buffer tank 112 through a one-way valve 128. Moreover, each of the tubes is connected by couplers 113.

The supply side pump 118 is, for example, configured by a tube pump that uses a stepping motor (not shown in the drawings) (the rotational driving resulting from the stepping motor is used to squeeze a tube having elastic force and supply the ink L inside the tube). However, the supply side pump 118 is not particularly limited to this kind of pump. Furthermore, one end of a drain tube 132 is coupled to the ink sub-tank chamber 94A, and the other end of the drain tube 132 is coupled to the buffer tank 112. Additionally, a supply side drain valve 134 is disposed in the drain tube 132.

The supply side sub-tank 94 has a structure where air bubbles inside the flow passage are trapped by circulating the ink L. Consequently, in a case in which the supply side drain valve 134 is opened and the air bubbles inside the supply side sub-tank 94 are sent to the buffer tank 112 by the driving force of the supply side pump 118, the air bubbles are expelled from the buffer tank 112 that is open to the atmosphere.

Next, the other end of the recovery tube 76 coupled to the recovery side manifold 64 is coupled to a recovery side sub-tank 142. The recovery side sub-tank 142 has a two chamber structure where its inside is partitioned by a membrane member 144 having elastic force, so that the lower side is an ink sub-tank chamber 146A and the upper side is an air chamber 146B. One end of a recovery side main tube 148 for drawing the ink L to the buffer tank 112 is coupled to the ink sub-tank chamber 146A. Additionally, an open tube 152 is coupled to the air chamber 146B, and a recovery side air connect valve 154, a recovery side air tank 156, and a recover side air valve 158 are disposed in the open tube 152.

A recovery side pump 149 is disposed in the recovery side main tube 148. Furthermore, a pressurization purge tube 162 is disposed between an inlet side of the recovery side pump 149 and an outlet side of the degassing module 114 in the supply side main tube 98. A one-way valve 168 and a recovery filter 170 are disposed in this order, from the degassing module 114 to the recovery side pump 149, in the pressurization purge tube 162. Namely, in a case in which reducing air bubbles and so forth by pressurizing the insides of the head modules 50 to expel the ink at once, the driving direction of the recovery side pump 149 is reversed from what it is normally in addition to the driving of the supply side pump 118. Accordingly, the inkjet recording apparatus 10 supplies the degassed ink L from the buffer tank 112 to the recovery side manifold 64.

The ink L can be circulated from the main tank 56 to the buffer tank 112 by a refill tube 172 in which a refill pump 176 is disposed. An ink quantity necessary to circulate the ink L is stored in the buffer tank 112, and the buffer tank 112 is refilled with the ink L from the main tank 56 in accordance with the consumption of the ink L. A filter 174 is disposed on one end of the refill tube 172 (inside the main tank 56). An overflow tube 178 is disposed between the buffer tank 112 and the main tank 56, and in a case in which the buffer tank 112 is over refilled with the ink L, the ink L is returned to the main tank 56.

One end of a branch tube 164 is connected to the recovery side main tube 148 on the upstream side of the recovery side pump 149, and the other end of the branch tube 164 is connected to the overflow tube 178. Additionally, a safety valve 165 is disposed in the branch tube 164. Moreover, one end of a branch tube 166 is connected to the recovery side main tube 148 on the downstream side of the recovery side pump 149, and the other end of the branch tube 166 is connected to the refill tube 172 on the downstream side of the refill pump 176. Additionally, a one-way valve 167 is disposed in the branch tube 166.

The inkjet recording apparatus 10 uses the driving force of the recovery side pump 149 to recover the ink L inside the recovery side sub-tank 142 to the buffer tank 112. Furthermore, one end of a drain tube 147 is coupled to the ink sub-tank chamber 146A, and the other end of the drain tube 147 is connected to the drain tube 132 through a recovery side drain valve 151.

The recovery side sub-tank 142 has a structure where air bubbles inside the flow passage are trapped by circulating the ink L. Consequently, by opening the recovery side drain valve 151, the air bubbles inside the recovery side sub-tank 142 are sent to the buffer tank 112 by driving force resulting from the reverse rotation of the recovery side pump 149, and the air bubbles are expelled from the buffer tank 112 that is open to the atmosphere.

Furthermore, one end of a branch tube 182 is connected to the supply side main tube 98 between the supply side filter 122 and the ink temperature regulator 124. The other end of the branch tube 182 is connected to the overflow tube 178 on the downstream side of the position where the overflow tube 178 connects to the branch tube 164. Additionally, a safety valve 184 is disposed in the branch tube 182.

In the present exemplary embodiment, the relationship between the pressure P1 in the supply side manifold 58 and the pressure P2 in the recovery side manifold 64 is such that P1>P2, but they are each a negative pressure supply. Namely, the supply pressure of the supply side pump 118 is a negative pressure, and the recovery pressure of the recovery side pump 149 is also a negative pressure. For this reason, the ink flows from the supply side manifold 58 to the recovery side manifold 64, and the back pressure P3 of the nozzles 24 of the head modules 50 is maintained at a negative pressure. Strictly speaking, the height positions of the supply side manifold 58 and the recovery side manifold 64, the ink flow amount, and the flow passage resistance act as factors of the back pressure P3, so they need to be taken into consideration in a case in which setting the pressure P1 on the input side and the pressure P2 on the output side.

Next, the head modules 50 will be described.

Figure 3:
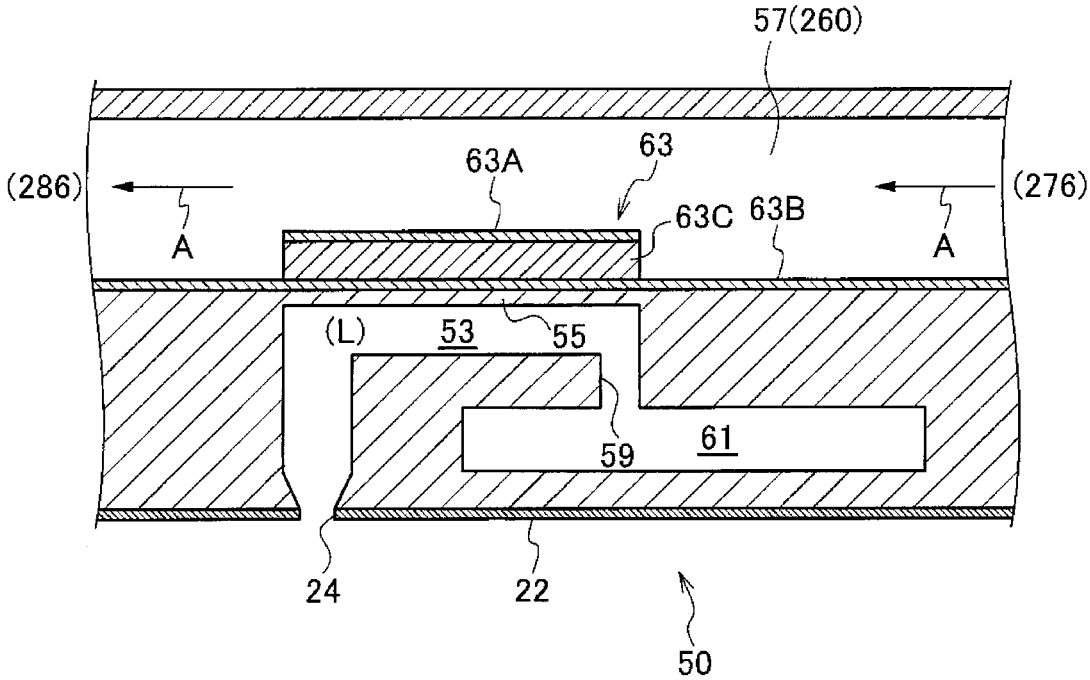
FIG. 3 is a longitudinal sectional view of a head module pertaining to the first exemplary embodiment.

As shown in FIG. 3, each of the head modules 50 has a nozzle 24 for ejecting the ink L, a pressure chamber 53 connected to the nozzle 24, a diaphragm 55 configuring the ceiling of the pressure chamber 53, and a piezoelectric element 63 attached to the upper surface of the diaphragm 55. The pressure chamber 53 is connected to a common flow passage 61 via a supply opening 59. The common flow passage 61 is connected to the supply side manifold 58 (see FIG. 2) via the supply side branch passage 62 (see FIG. 2).

The piezoelectric element 63 has a structure where a piezoelectric body 63C is sandwiched between an upper electrode 63A and a lower electrode 63B. Additionally, in a case in which a drive voltage is applied between the upper electrode 63A and the lower electrode 63B from a power supply (not shown in the drawings), the piezoelectric element 63 deforms and the pressure chamber 53 deforms because of the flexural deformation of the piezoelectric element 63. Accordingly, the ink L accommodated inside the pressure chamber 53 is pressurized so that ink droplets LA (see FIG. 1) are ejected from the nozzle 24. When the flexural deformation of the piezoelectric element 63 is restored to its original state, the ink L fills the pressure chamber 53 via the supply opening 59 from the common flow passage 61. Furthermore, a gas delivery chamber 57, which is disposed in a flow passage of a later-described supply tube 270 (see FIG. 8) and forms a space in which the piezoelectric element 63 is disposed, is formed in the head module 50.

Later-described dry air (indicated by arrow A) is supplied to the gas delivery chamber 57 from a later-described ventilation unit 262 (see FIG. 8). Furthermore, the gas delivery chamber 57 has a configuration where, in a case in which dry air exceeding the capacity of the gas delivery chamber 57 has been introduced thereto, the air is recovered to the outside via a recovery opening (not shown in the drawings).

Next, a controller 200 of the inkjet recording apparatus 10 will be described.

Figure 4:
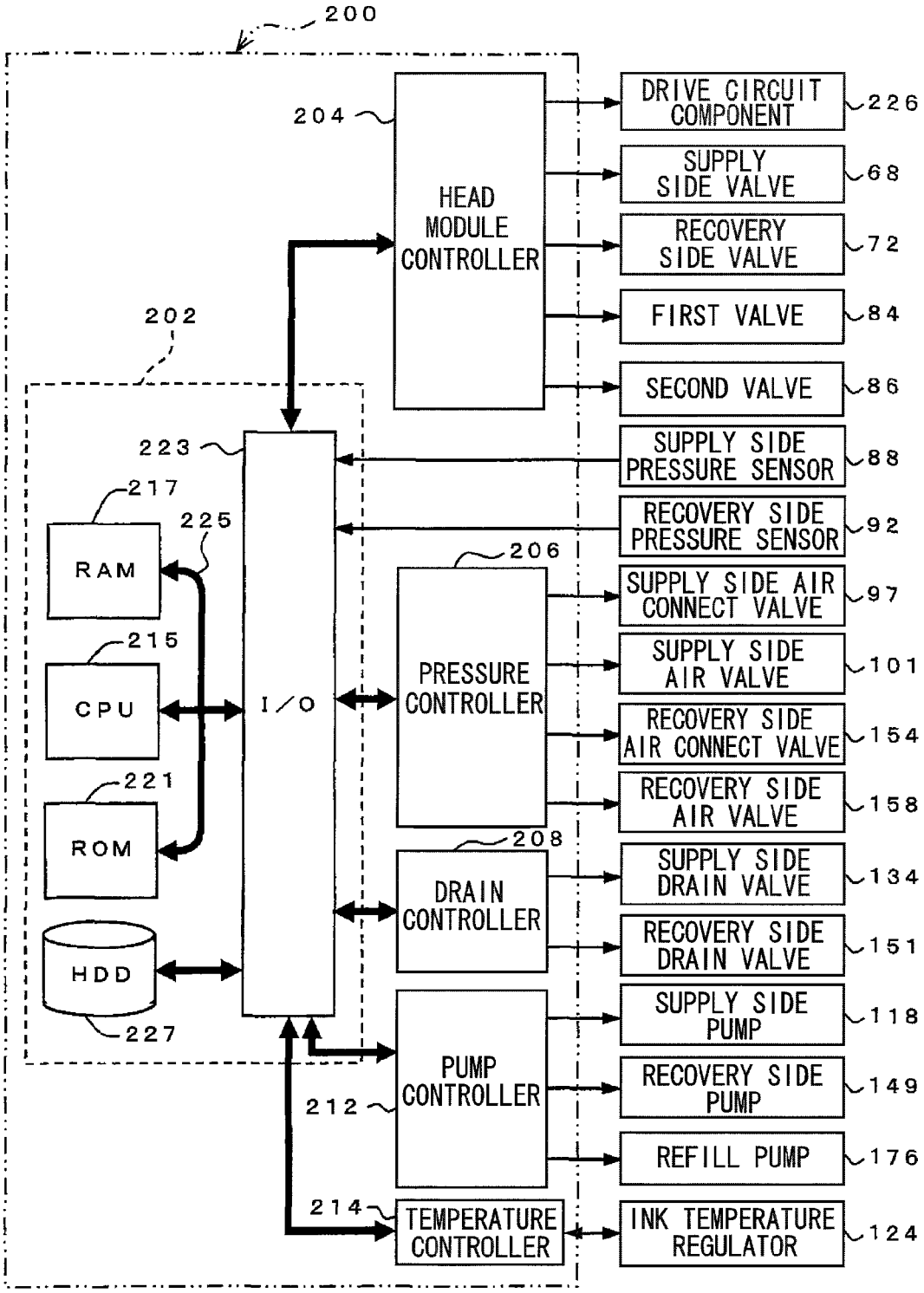
FIG. 4 is a block diagram of a controller that controls the operation of the inkjet head pertaining to the first exemplary embodiment.

As shown in FIG. 4, the inkjet recording apparatus 10 has a controller 200 that controls the operations of each part on the basis of input signals and causes the ink L to be ejected from the head modules 50 (see FIG. 2).

The controller 200 is configured to include a microcomputer 202 and a head module controller 204, a pressure controller 206, a drain controller 208, a pump controller 212, and a temperature controller 214 that are connected to the microcomputer 202. The microcomputer 202 has a CPU 215, a RAM 217, a ROM 221, an I/O section 223, and a bus 225 such as a data bus or a control bus that interconnects these.

A hard disk drive (HDD) 227 is connected to the I/O section 223. Furthermore, the supply side pressure sensor 88 and the recovery side pressure sensor 92 are connected to the I/O section 223. Moreover, image data in a case in which forming an image by ejecting the ink L from the nozzles 24 of the head modules 50 (see FIG. 2) are input to the I/O section 223 from outside. The image data may be data where the ink ejecting positions and ejecting quantities are defined or may be compressed data such as JPEG. Furthermore, the CPU 215 reads and executes an ink circulation system program stored in the ROM 221.

The ink circulation system program includes, for example, a circulation control program, a control program, and a purge control program. The circulation control program causes the ink L inside the buffer tank 112 shown in FIG. 2 to flow and circulate from the supply side manifold 58 to the recovery side manifold 64. The control program causes ink droplets LA (see FIG. 1) to be ejected from the nozzles 24 in accordance with the image data. The purge control program expels (purges) air bubbles generated inside the head modules 50. The ink circulation system program is not limited to being stored in the ROM 221 and may also be stored in the HDD 227 or an external storage medium (not shown in the drawings) and acquired from a network (not shown in the drawings) such as a LAN or a reader that reads information in a case in which the external storage medium is loaded.

In the description hereinafter, the case in which control to eject the ink droplets LA (see FIG. 1) from the nozzles 24 in order to record (form) an image on the recording medium P is performed on the basis of the control program will be called a normal recording case, and the case in which preparations are made so as to make normal recording possible will be called a maintenance case.

As shown in FIG. 4, the CPU 215 controls the operations of the head module controller 204, the pressure controller 206, the drain controller 208, the pump controller 212, and the temperature controller 214 connected to the I/O section 223 on the basis of the circulation control program it has read.

A later-described drive circuit section 226, which includes the piezoelectric elements 63 (see FIG. 3) and the power supply (not shown in the drawings) and drives the piezoelectric elements 63, the supply side valve 68, the recovery side valve 72, the first valve 84, and the second valve 86 are connected to the head module controller 204. Furthermore, the supply side air connect valve 97, the supply side air valve 101, the recovery side air connect valve 154, and the recovery side air valve 158 are connected to the pressure controller 206.

The supply side drain valve 134 and the recovery side drain valve 151 are connected to the drain controller 208. Furthermore, the supply side pump 118, the recovery side pump 149, and the refill pump 176 are connected to the pump controller 212. Moreover, the ink temperature regulator 124 is connected to the temperature controller 214.

Next, the inkjet heads 20 will be described.

Figure 5:
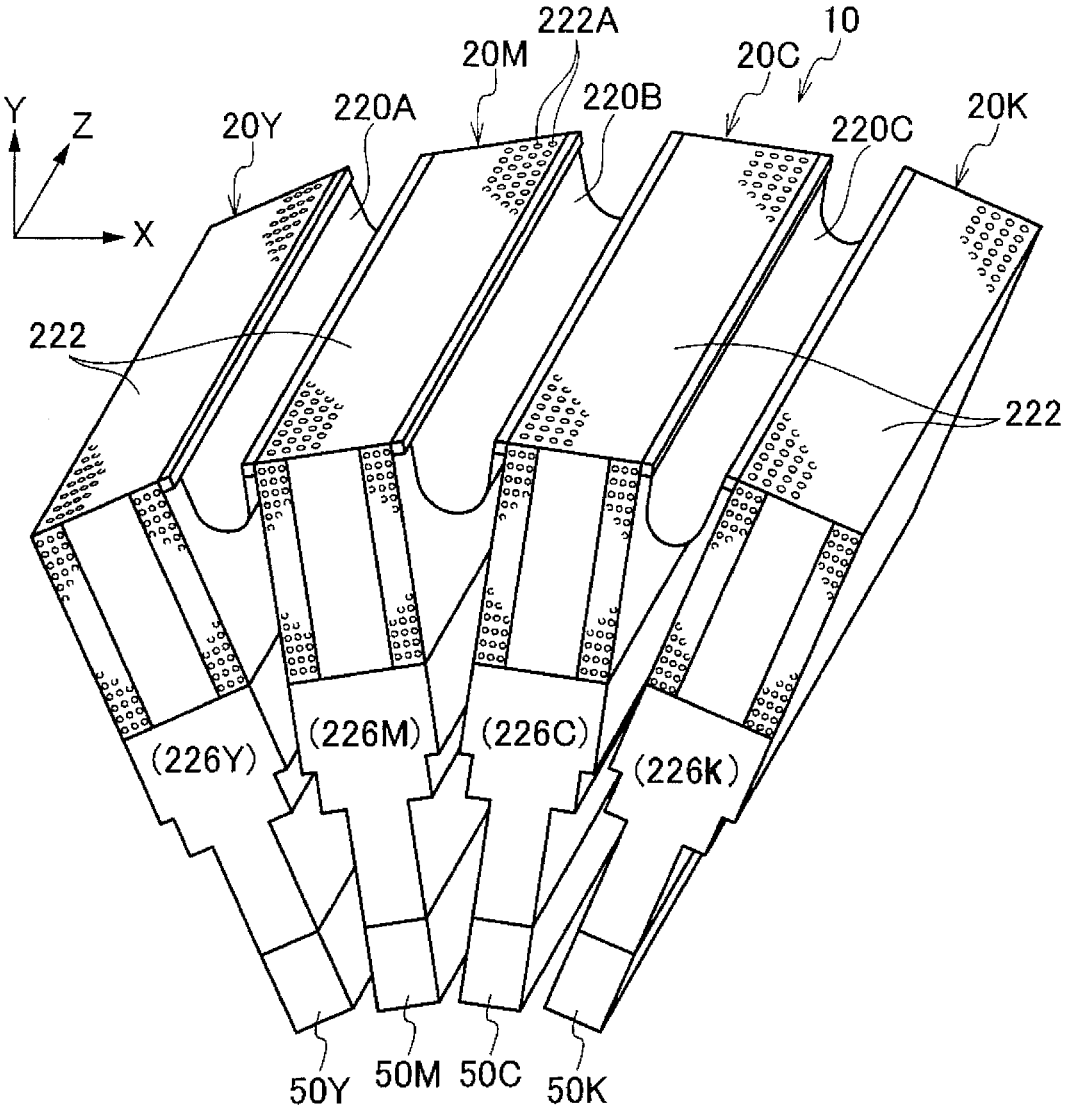
FIG. 5 is a perspective view showing the outer appearance of four inkjet heads pertaining to the first exemplary embodiment.

As shown in FIG. 5, the inkjet recording apparatus 10 is disposed with the inkjet heads 20Y, 20M, 20C, and 20K. Additionally, protective sheets 220A, 220B, and 220C serving as an example of regulating members that regulate outflow of air delivered to heat sinks 252 (see FIG. 7) are disposed between the inkjet head 20Y and the inkjet head 20M, between the inkjet head 20M and the inkjet head 20C, and between the inkjet head 20C and the inkjet head 20K, respectively. The protective sheets 220A, 220B, and 220C are an example of regulating members that regulate outflow of air delivered to heat sinks 252 (see FIG. 7).

The protective sheets 220A, 220B, and 220C are sheet materials made of a synthetic resin, and polyethylene sheets, for example, are used. Furthermore, the protective sheets 220A, 220B, and 220C each have a width longer than the intervals between the inkjet heads 20 and are attached in a state in which they sag convexly downward between the inkjet heads 20.

Furthermore, each of the inkjet heads 20 has a head cover 222 that covers a support frame 224 (see FIG. 6) serving as a body. The head cover 222 is made of stainless steel, for example, and plural through holes 222A of a size through which air can pass are formed in the head cover 222.

Figure 6:
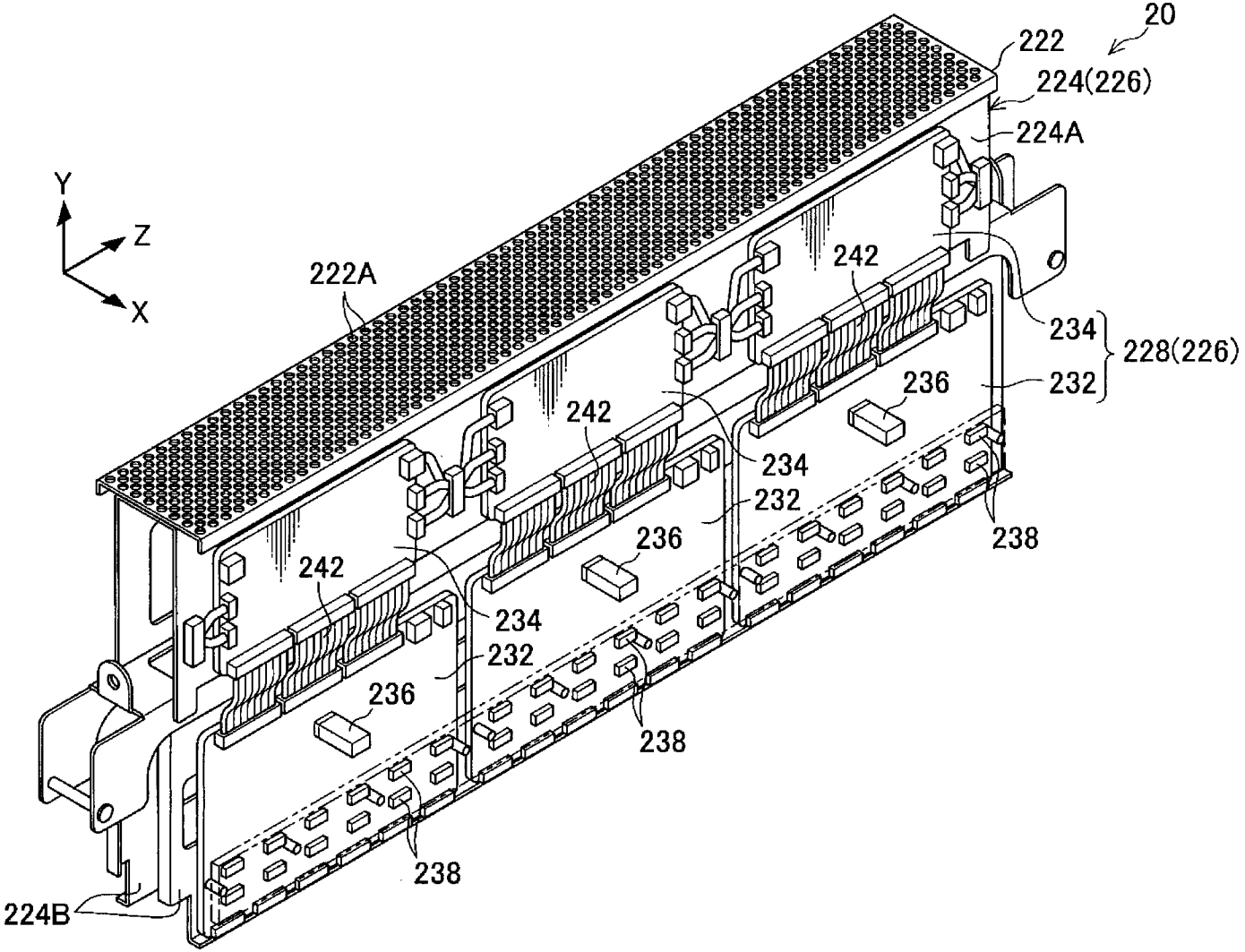
FIG. 6 is a perspective view of the inkjet head pertaining to the first exemplary embodiment in a state in which a head cover has been removed to expose driver ICs.

In FIG. 6, the inkjet head 20 is shown in a state in which the head modules 50 (see FIG. 5) and side portions of the head cover 222 have been removed. Furthermore, the inkjet head 20 has a drive circuit section 226 that drives the piezoelectric elements 63 (see FIG. 3) and so forth. The drive circuit section 226 is controlled by the head module controller 204 (see FIG. 4).

The drive circuit section 226 is equipped with a drive circuit board 228 for driving the piezoelectric elements 63 (see FIG. 3) and the support frame 224 that supports the drive circuit board 228. Furthermore, the drive circuit board 228 is configured by plural processing boards and is equipped with analog processing boards 232 and digital processing boards 234.

The digital processing boards 234 perform digital processing that determines, in accordance with image signals, the timing when the ink droplets LA (see FIG. 1) are to be ejected and the nozzles 24 (see FIG. 2) that are to be used. Furthermore, the analog processing boards 232 perform analog processing that applies drive signals to the piezoelectric elements (see FIG. 3) corresponding to the nozzles 24 that have been determined by the digital processing boards 234. Plural transistors 236 and driver ICs 238 serving as an example of drive sections that drive the piezoelectric elements 63 (see FIG. 3) are disposed on the analog processing boards 232.

Figure 10A:
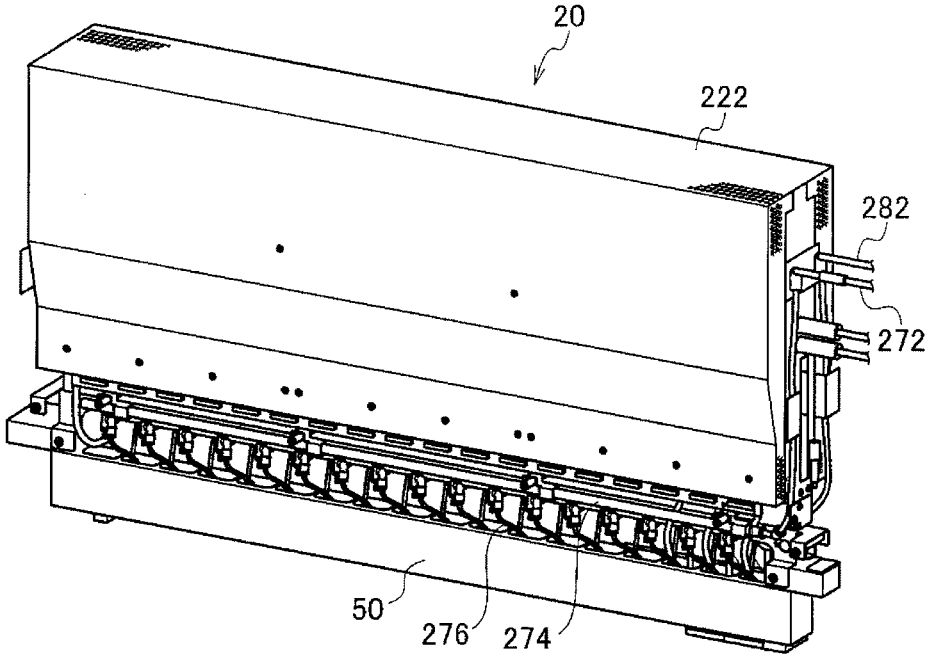
FIG. 10A is a perspective view of an air supply side of the inkjet head pertaining to the first exemplary embodiment.
Figure 10B:
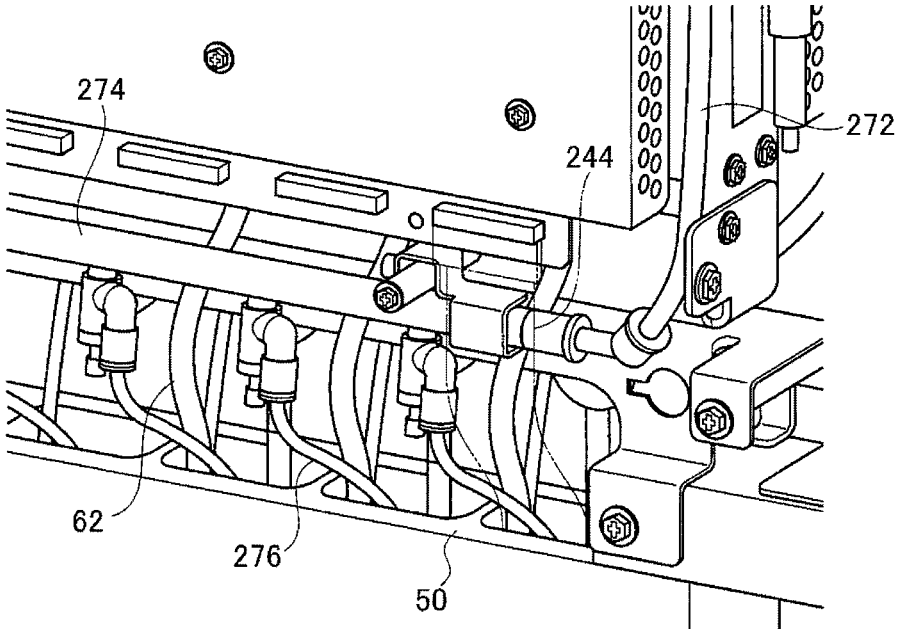
FIG. 10B is a partially enlarged view of the air supply side of the inkjet head pertaining to the first exemplary embodiment.
Figure 11A:
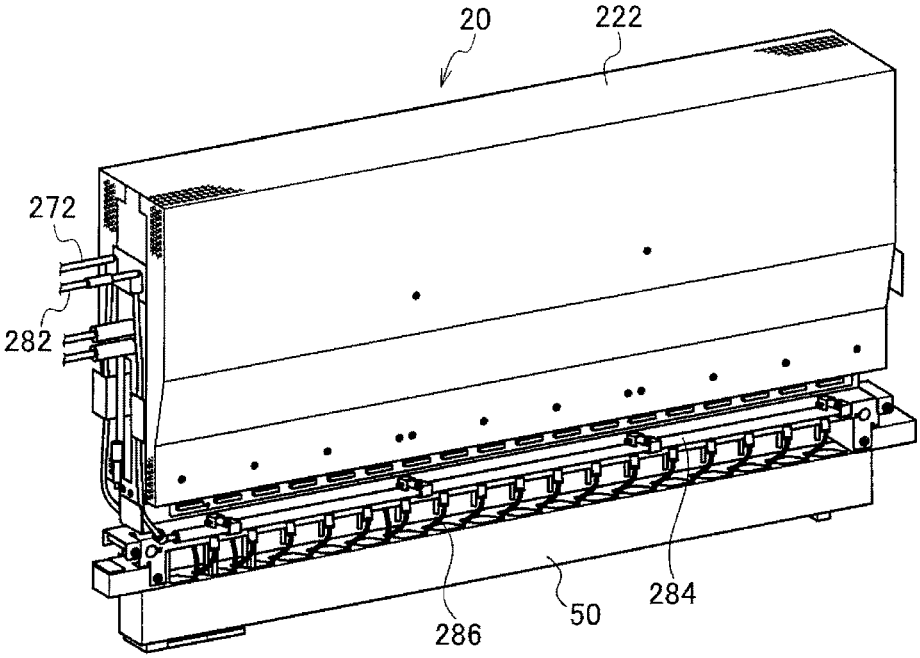
FIG. 11A is a perspective view of an air recovery side of the inkjet head pertaining to the first exemplary embodiment.
Figure 11B:
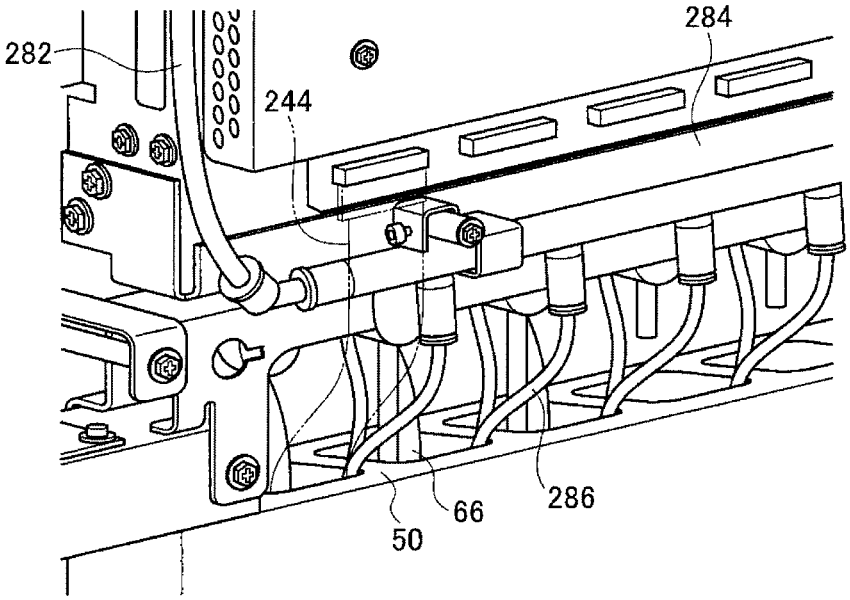
FIG. 11B is a partially enlarged view of the air recovery side of the inkjet head pertaining to the first exemplary embodiment.

The digital processing boards 234 and the analog processing boards 232 are electrically connected to one another by flexible wiring 242. Additionally, the analog processing boards 232 and the head modules 50 (see FIG. 5) are electrically connected to one another by flexible wiring 244 (see FIG. 10B and FIG. 11B).

The support frame 224 has a frame body portion 224A and a pair of frame arm portions 224B that extend downward from the frame body portion 22A, so that the support frame 224 has a U-shape as seen in a side view. Namely, the frame body portion 224A is disposed on the opposite side of the head modules 50, and the frame arm portions 224B are disposed between the frame body portion 224A and the head modules 50. Furthermore, the digital processing boards 234 are disposed on the side surfaces of the frame body portion 224A, and the analog processing boards 232 are disposed on the side surfaces of the frame arm portions 224B.

Figure 7:
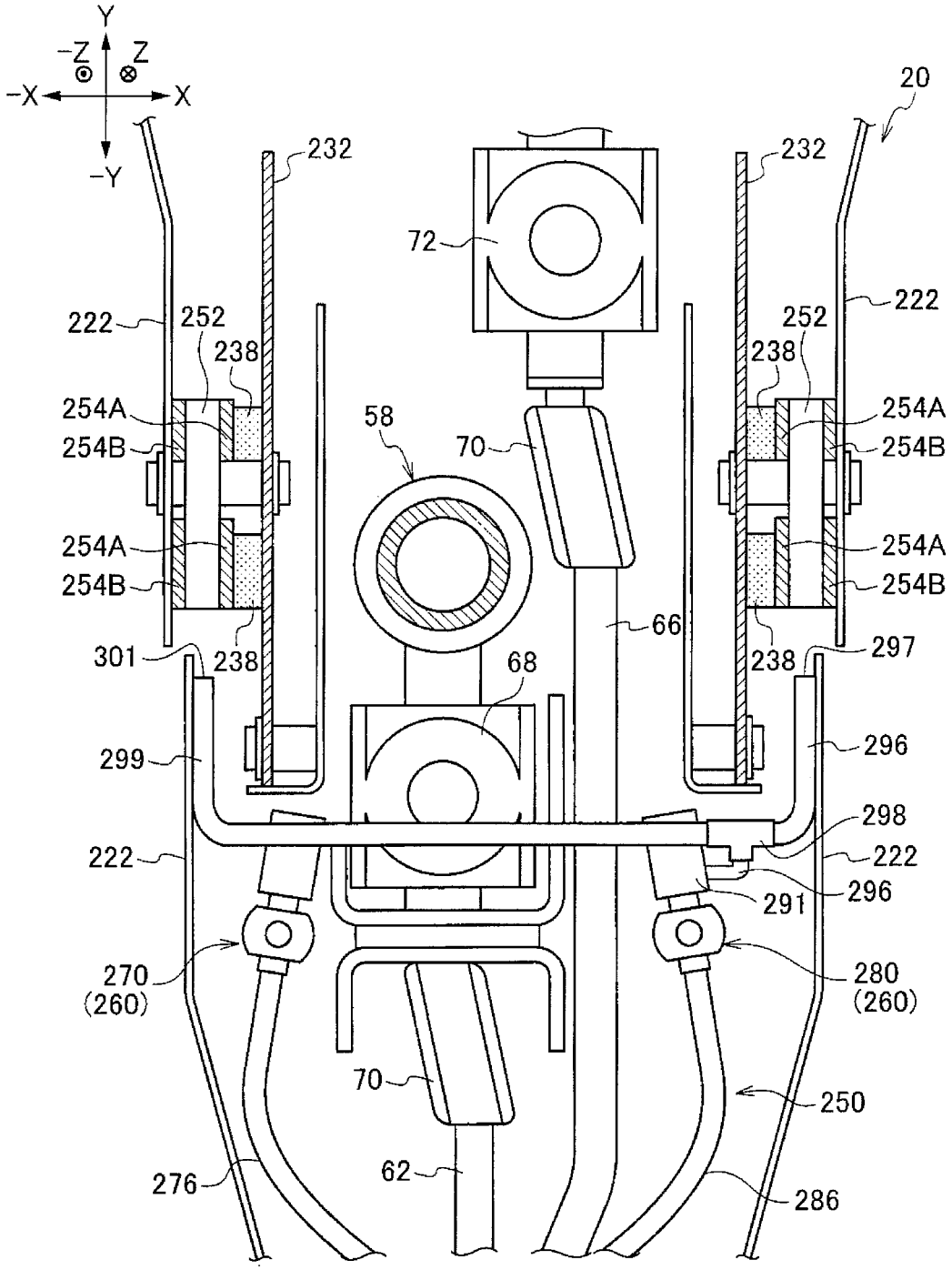
FIG. 7 is a longitudinal sectional view of the inkjet head pertaining to the first exemplary embodiment.

As shown in FIG. 7, looking at the inkjet head 20 in the Z direction, a heat sink 252 and thermally conductive sheets 254A and 254B are disposed between the driver ICs 238 and the head cover 222 on the X direction side. The thermally conductive sheets 254A and 254B are configured by silicon rubber sheets, for example, but they are not limited to this, and grease may also be used. In the present exemplary embodiment, the heat sink 252 is also included in the example of the drive section.

Specifically, the thermally conductive sheets 254A are in contact with the X direction side surfaces of the driver ICs 238, and the heat sink 252 is in contact with the X direction side surfaces of the thermally conductive sheets 254A. Moreover, the thermally conductive sheets 254B are in contact with the X direction side surface of the heat sink 252, and the head cover 222 is in contact with the X direction side surfaces of the thermally conductive sheets 254B. A heat sink 252 and thermally conductive sheets 254A and 254B are also disposed between the driver ICs 238 and the head cover 222 disposed on the −X direction side. These have the same configuration, so description thereof will be omitted.

Next, a gas delivery unit 250 will be described.

In FIG. 8, FIG. 10A, FIG. 10B, FIG. 11A, and FIG. 11B, there is shown an gas delivery unit 250 that delivers air to the environs of the piezoelectric elements 63 inside the gas delivery chambers 57 already discussed (see FIG. 3).

Figure 8:
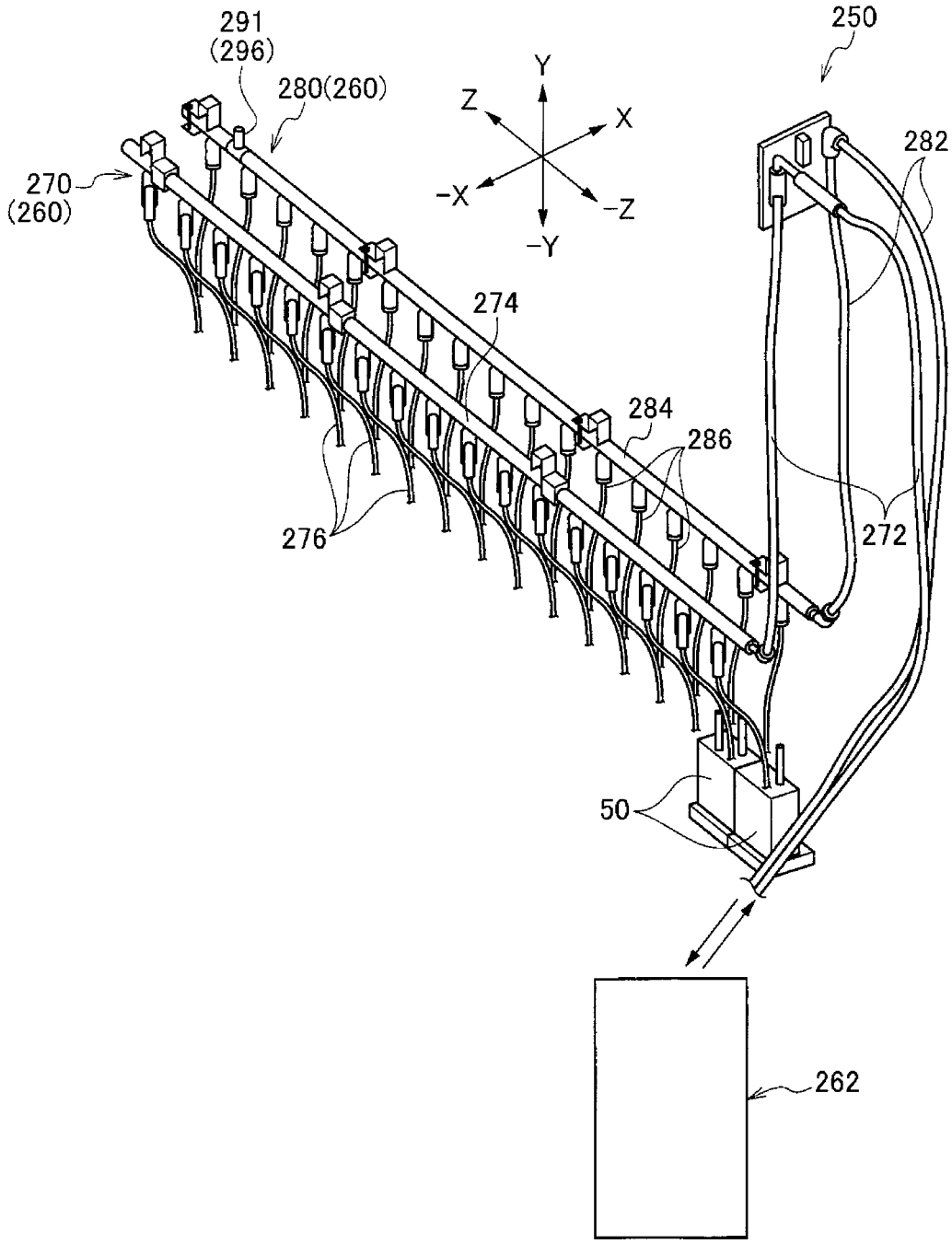
FIG. 8 is an explanatory view showing the overall configuration of an air flow passage of the inkjet head pertaining to the first exemplary embodiment.

As shown in FIG. 8, the gas delivery unit 250 is configured to include a gas delivery passage 260, a ventilation unit 262, and a branch tube 296 (see FIG. 7). The piezoelectric elements 63 (see FIG. 3) are disposed in the gas delivery passage 260. The ventilation unit 262 is an example of a gas delivery section that delivers a dry gas to the environs of the piezoelectric elements 63 via the gas delivery passage 260. The branch tube 296 (see FIG. 7) is an example of a branch passage that branches from the gas delivery passage 260.

The gas delivery passage 260 is configured to include a supply tube 270, the gas delivery chambers 57, and a recovery tube 280. The supply tube 270 supplies, to the piezoelectric elements 63 (see FIG. 3) of the plural head modules 50, the dry gas that has been supplied from the ventilation unit 262. The piezoelectric elements 63 are disposed in the gas delivery chambers 57. The recovery tube 280 recovers the air (including moisture) after cooling the piezoelectric elements 63 and returns the air to the ventilation unit 262.

The supply tube 270 has a supply side tube 272 having one end connected to the ventilation unit 262, a supply side air manifold 274 connected to the other end of the supply side tube 272, and plural supply side individual tubes 276 that plurally branch from the supply side air manifold 274 and are connected to the gas delivery chambers 57 (see FIG. 3).

The recovery tube 280 has a recovery side tube 282 having one end connected to the ventilation unit 262, a recovery side air manifold 284 connected to the other end of the recovery side tube 282, and plural recovery side individual tubes 286 that plurally branch from the recovery side air manifold 284 and are connected to the gas delivery chambers 57 on the opposite side of the supply side individual tube 276 side. In FIG. 8, two head modules 50 are illustrated while illustration of the remaining head modules 50 is omitted.

Here, the "dry gas" in the present exemplary embodiment is a gas in a state in which the dew point becomes equal to or lower than minus 4.4 degrees, and exhibits the function of absorbing moisture in the atmosphere to lower the humidity in the atmosphere. The "dew point of the dry gas" may be found by measuring it with a dew point thermometer or may be calculated by finding the water vapor pressure from the air temperature and the relative humidity and finding the temperature at which the water vapor pressure becomes a saturated water vapor pressure. In the description hereinafter, "dry air" will be described as an example of the "dry gas".

Figure 9:
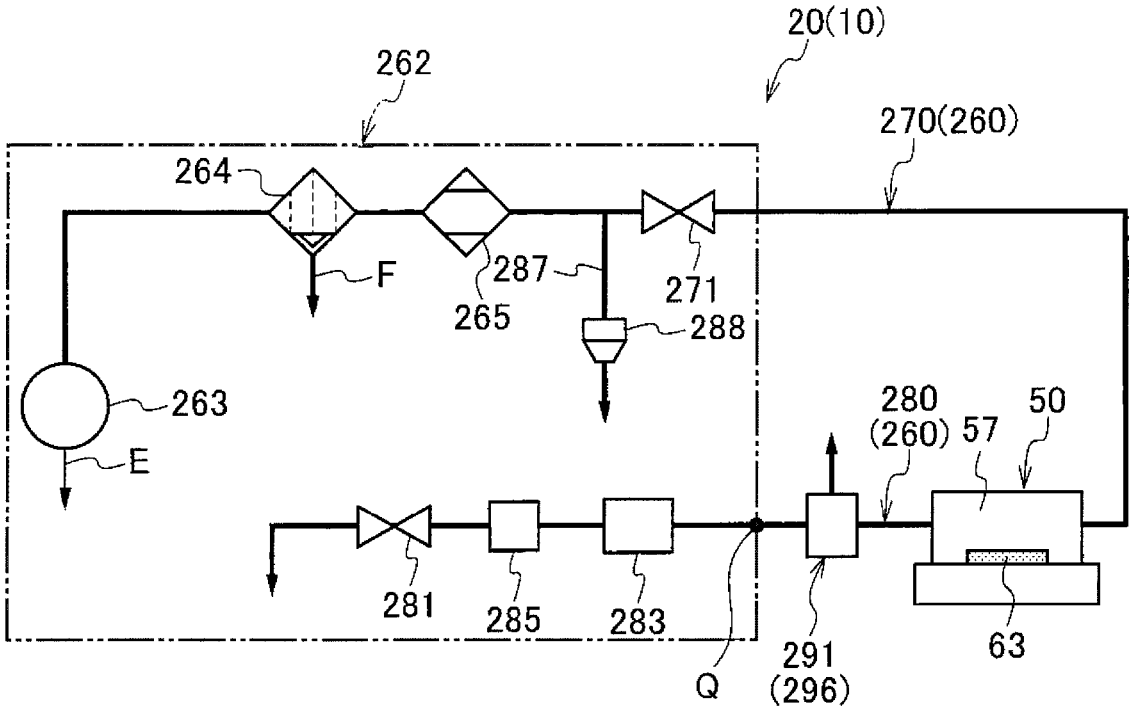
FIG. 9 is a schematic diagram showing the configuration of a ventilation unit pertaining to the first exemplary embodiment.

As shown in FIG. 9, one end and the other end of the gas delivery passage 260 are connected to the ventilation unit 262. The ventilation unit 262 is configured to supply the dry air to the gas delivery chambers 57 disposed in the head modules 50 so that the dew point of the air around the piezoelectric elements 63 is kept equal to or lower than a set value.

Specifically, the ventilation unit 262 has, sequentially from the upstream side to the downstream side in the direction in which the dry air flows, a compressor 263 that generates compressed air, a filter 264 that removes foreign particle such as dust from the compressed air that has been generated by the compressor 263, and an air dryer 265 that generates dry air from the compressed air from which foreign particle has been removed by the filter 264. Moreover, the ventilation unit 262 has a supply valve 271 connected to the supply tube 270, a relief valve 288, a humidity sensor 283 disposed in the recovery tube 280, a flow amount sensor 285, and a recovery valve 281.

The compressor 63 is, for example, configured to introduce 0.5 mega-Pascal compressed air to the air dryer 265. Furthermore, a drain tube (not shown in the drawings) for expelling (indicated by arrow E) water generated in a case in which compressing the air is disposed in the compressor 263.

For the filter 264, a configuration including an air filter that removes dusts in the air and an oil filter that removes oil component in the air is used. A drain tube (not shown in the drawings) for expelling (indicated by arrow F) water, trapped dust, and oil components are disposed in the filter 264.

The air dryer 265 is, for example, configured by a refrigerated air dryer that removes airborne water by lowering the temperature. A desiccant air dryer may also be used for the air dryer 265. Furthermore, the air dryer 265 is connected to the gas delivery chambers 57 by the supply tube 270. Additionally, by opening the supply valve 271, the air dryer 265 and the gas delivery chambers 57 become connected to one another, and by closing the supply valve 271, the air dryer 265 and the gas delivery chambers 57 become cut off from one another. Namely, in a case in which the dry air is supplied to the gas delivery chambers 57, the supply valve 271 is opened so that the dry air is introduced to the gas delivery chambers 57 from the air dryer 265. In a case in which the supply of the dry air to the gas delivery chambers 57 is stopped, the supply valve 271 is closed.

The relief valve 288 is disposed in a tube 287 connected to the supply tube 270 between the air dryer 265 and the supply valve 271. Furthermore, the relief valve 288 has a function where the valve automatically opens in a case in which the pressure of the dry air has exceeded a set value.

The gas delivery chambers 57 are connected to the supply tube 270 and the recovery tube 280. Additionally, the other end of the recovery tube 280 is open to the atmosphere, and by opening or closing the recovery valve 281, the gas delivery chambers 57 become open to or cut off from the atmosphere. When the dry air is supplied to the gas delivery chambers 57, the recovery valve 281 is opened so that the insides of the gas delivery chambers 57 are kept with high pressure. Furthermore, in a case in which the supply of the dry air to the gas delivery chambers 57 is stopped, the recovery valve 281 is closed.

The humidity sensor 283 detects the humidity of the air that has been recovered from the gas delivery chambers 57 (here, because this air has absorbed moisture, the air is simply called "air" to distinguish it from "dry air"). Accordingly, humidity information is acquired. Additionally, on the basis of the humidity information that has been obtained by the humidity sensor 283, the humidity inside the gas delivery chambers 57 is grasped by the controller 200 (see FIG. 4).

The flow amount sensor 285 is an example of detecting section that detects the flow amount of the air that the ventilation unit 262 has delivered. Additionally, the ventilation unit 262 is feedback controlled in such a way that the flow amount of the air that has been detected by the flow amount sensor 285 becomes equal to or greater than a set amount, and the ventilation unit 262 delivers the air to the environs of the piezoelectric elements 63. Furthermore, the flow amount sensor 285 is disposed in the recovery tube 280 (the gas delivery passage 260) at the downstream side than the later-described branch tube 296. Moreover, the branch tube 296 is disposed in the recovery tube 280 between the gas delivery chambers 57 and the humidity sensor 283.

As shown in FIG. 7, the branch tube 296 branches from the recovery tube 280 (the gas delivery passage 260) and is disposed with its side opposite the recovery tube 280 side facing the heat sink 252. Specifically, the branch tube 296 branches from the gas delivery passage 260 at the downstream side than the piezoelectric elements 63 (see FIG. 9). Additionally, the branch tube 296 is disposed in such a way that some of the air that has been delivered from the gas delivery unit 250 is blown onto the heat sink 252 on the X direction side of the inkjet head 20.

Furthermore, a branch connector 298 that forks into two, for example, is disposed in the branch tube 296, and one end of a branch tube 299 is connected to the branch connector 298 on the opposite side of the branch tube 296 side. The branch tube 296 is divided into two tubes, with one tube each being connected to the upstream side and the downstream side of the branch connector 298. However, in order to show the flow of the air in a way that is easier to understand, the branch tube 296 on the upstream side of the branch connector 298 and the branch tube 296 on the downstream side are denoted by the same reference signs.

The branch tube 299 extends in the −X direction from the branch connector 298, the distal end portion of the branch tube 299 is bent in the Y direction at the position where the branch tube 299 contacts the head covers 22, and a cooling opening 301 (open end) in the branch tube 299 is disposed facing the heat sink 252 on the −X direction side.

A duckbill valve 291 serving as an example of cutoff section and a one-way valve is disposed in a position in the branch tube 296 on the upstream side of the branch connector 298 (the position where the branch tube 296 branches from the recovery tube 280).

Figure 12A:
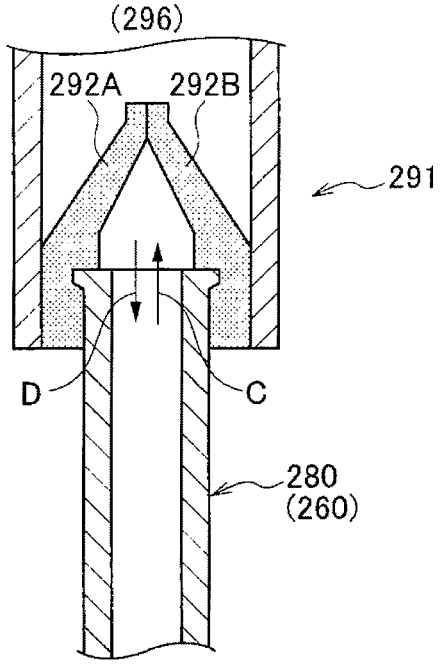
FIG. 12A is a longitudinal sectional view showing a state in which a check valve pertaining to the first exemplary embodiment has been closed.
Figure 12B:
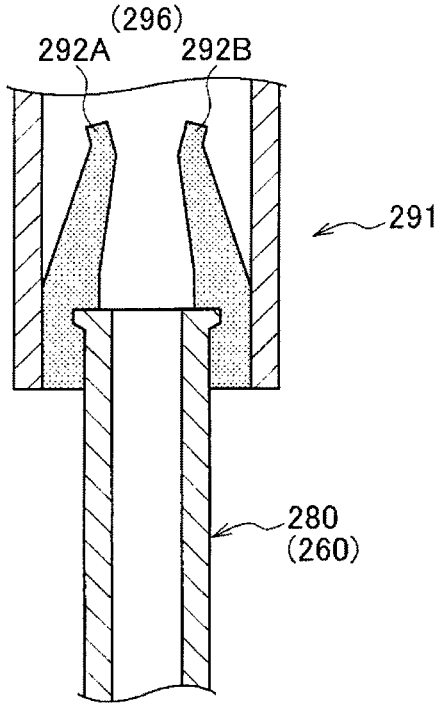
FIG. 12B is a longitudinal sectional view showing a state in which the check valve pertaining to the first exemplary embodiment has been opened.

As shown in FIG. 12A and FIG. 12B, the duckbill valve 291 has check valves 292A and 292B having elasticity. The check valves 292A and 292B are urged in a direction in which they close the flow passage by their own elastic force, and in a case in which the ventilation unit 262 (see FIG. 9) starts gas delivery, the check valves 292A and 292B are opened by the difference in pressure between the gas delivery passage 260 and the branch tube 296. Namely, the duckbill valve 291 is configured by a one-way valve, and in a case in which the check valves 292A and 292B move away from one another under a difference in pressure in a forward direction (the direction of arrow C illustrated in the drawing), this allows the gas to be delivered from the gas delivery passage 260 to the branch tube 296. When the check valves 292A and 292B come into contact with one another under a difference in pressure in a reverse direction (the direction of arrow D in the drawing), this cuts off the flow of air from the branch tube 296 to the gas delivery passage 260. As was already mentioned, the forward direction downstream side of the duckbill valve 291 is open to the atmosphere.

As shown in FIG. 8, the branch tube 296 (and the branch tube 299) is configured in such a way that the air reaches from the one end to the other end of the gas delivery passage 260. For example, in a case in which R denotes the resistance of the cooling opening 297 (open end), n denotes the number of cooling openings, and T denotes the flow passage resistance to a return opening (position Q in FIG. 9) in the ventilation unit 262, the branch tube 296 is configured in such a way that $R/n>T$.

As shown in FIG. 1, FIG. 2, FIG. 3, and FIG. 4, in the inkjet recording apparatus 10, the pump controller 212 controls the operations of the supply side pump 118 and the recovery side pump 149 and regulates the back pressure and pressure difference so as to bring the back pressure and the pressure difference closer to target values. Accordingly, the ink L is circulated (supplied) in the order of the buffer tank 112, the degassing module 114, the supply side pump 118, the ink temperature regulator 124, the supply side main tube 98, the supply side sub-tank 94, the supply tube 74, the supply side manifold 58, the head modules 50, the recovery side manifold 64, the recovery tube 76, the recovery side sub-tank 142, the recovery side main tube 148, the recovery side pump 149, the branch tube 166, and the buffer tank 112. Additionally, in a case in which the head module controller 204 causes the drive circuit section 226 to operate, the ink droplets LA are ejected from the nozzles 24 onto the recording medium P.

Next, the action of the first exemplary embodiment will be described.

Figure 13A:
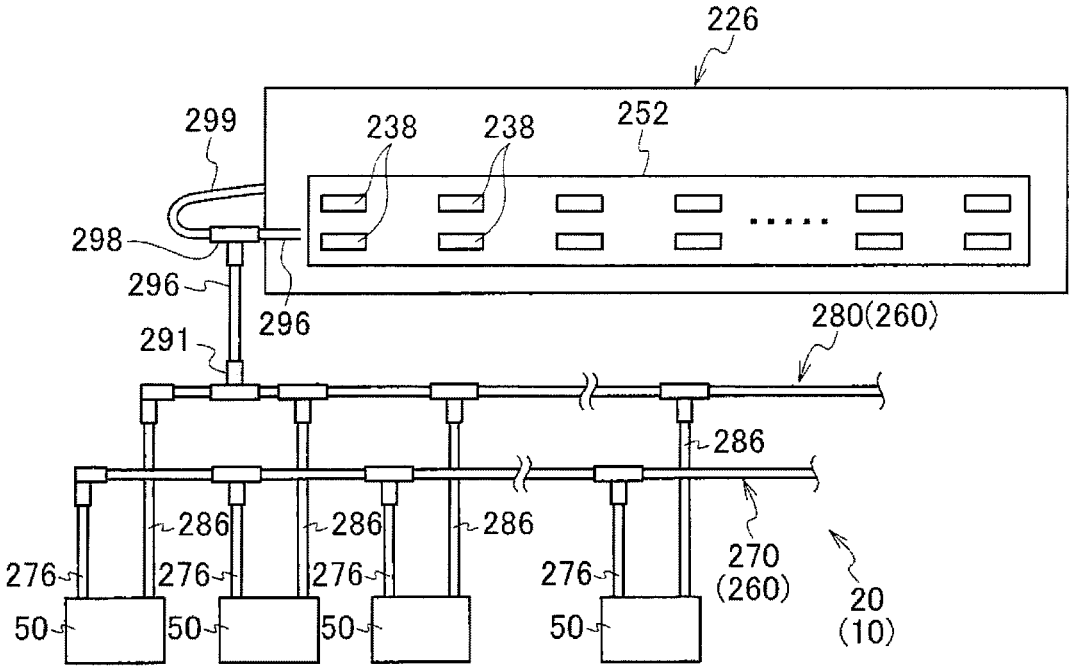
FIG. 13A is a schematic diagram showing the configuration of an air supply unit pertaining to the first exemplary embodiment.

As shown in FIG. 13A, in the drive circuit section 226 of the inkjet recording apparatus 10 of the first exemplary embodiment, one heat sink 252 is in contact with plural driver ICs 238. Additionally, the open end of the branch tube 296 is disposed facing the heat sink 252. Here, in a state in which air is not being delivered from the ventilation unit 262 (see FIG. 9) to the gas delivery passage 260, air is not delivered to the heat sink 252, so the plural driver ICs 238 are not cooled.

Figure 13B:
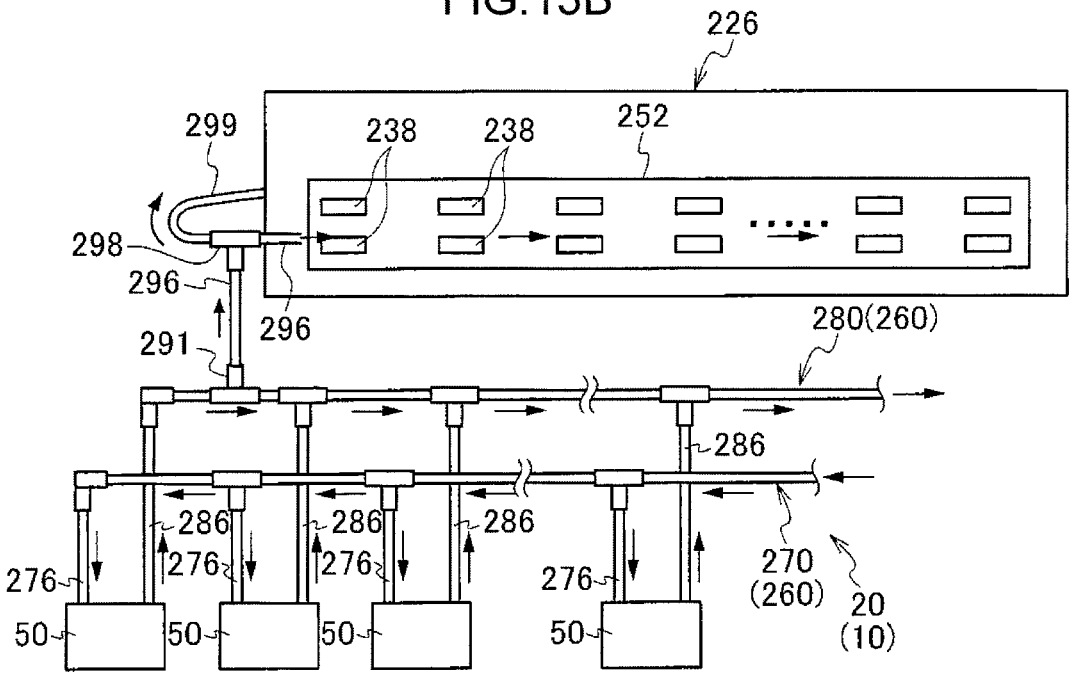
FIG. 13B is a schematic diagram showing a state in which the air supply unit pertaining to the first exemplary embodiment is used to deliver air to head modules and a heat sink.

Next, as shown in FIG. 9, in a case in which the ventilation unit 262 starts operation (gas delivery), as shown in FIG. 13B, the dry air (indicated by the arrows) travels through the supply tube 270 and is supplied to the gas delivery chambers 57 (see FIG. 3) of the head modules 50. Then, the air (indicated by the arrows) that has absorbed moisture in the gas delivery chambers 57 travels through the recovery tube 280 and flows toward the ventilation unit 262 (see FIG. 9).

Next, some of the air flowing through the recovery tube 280 flows through the branch tube 296 as a result of the duckbill valve 291 being opened and is blown onto the heat sink 252. In the drive circuit section 226, the heat of the plural driver ICs 238 emitting heat is conducted to the heat sink 252, but because the heat sink 252 is cooled by the air flow that has been blown onto, the temperature of the plural driver ICs 238 drops.

In this way, the ventilation unit 262 that generates and delivers the dry air in order to dehumidify the environs of the piezoelectric elements 63 also cools the heat sink 252 and the driver ICs 238, so the drive circuit section 226 of the piezoelectric elements 63 (see FIG. 3) is cooled with a simple configuration. Some of the air flowing through the branch tube 296 flows through the branch tube 299 and is blown onto the heat sink 252 on the opposite side (the −X direction side in FIG. 7). Additionally, in the drive circuit section 226 on the opposite side, the heat sink 252 is cooled by the air flow that has been blown onto it, so the temperature of the plural driver ICs 238 drops. Accordingly, the driver ICs 238 on both the X direction side and the −X direction side are cooled.

Furthermore, in the inkjet recording apparatus 10, the duckbill valve 291 is a one-way valve opened by the difference in pressure between the gas delivery passage 260 and the branch tube 296, so as long as the flow amount of gas delivery is managed in the ventilation unit 262, it is not necessary to control the opening and closing of the valve. For this reason, backflow of the air is suppressed with a simple configuration compared to a configuration using a control valve.

Moreover, in the inkjet recording apparatus 10, the branch tube 296 (and the branch tube 299) is disposed on the downstream side of the piezoelectric elements 63, so the air that has been supplied from the ventilation unit 262 (see FIG. 9) is delivered to the environs of the piezoelectric elements 63 and is thereafter split between the ventilation unit 262 side and the branch tube 296 (and the branch tube 299) side. Accordingly, in the inkjet recording apparatus 10, the flow of air is kept from no longer reaching the environs of the piezoelectric elements 63, so the dry air is more reliably delivered to the piezoelectric elements 63 (see FIG. 3).

In addition, in the inkjet recording apparatus 10, the resistance R of the cooling opening 297 in the branch tube 296 (and the cooling opening 301) and the number n of cooling openings are set in such a way that the air reaches from the one end to the other end of the gas delivery passage 260. Consequently, the air that the ventilation unit 262 has supplied returns back to the ventilation unit. Accordingly, in the inkjet recording apparatus 10, the air can be effectively utilized compared to a case where the branch tube 296 has a configuration where the air does not reach from the one end to the other end of the gas delivery passage 260.

Furthermore, in the inkjet recording apparatus 10, the flow amount sensor 285 detects the return amount of the air that the ventilation unit 262 has delivered, and in a case where the return amount (flow amount) is insufficient, the inkjet recording apparatus 10 performs control to increase the flow amount. Accordingly, in the inkjet recording apparatus 10, it is checked that the dry air for dehumidifying the environs of the piezoelectric elements 63 is being continuously supplied, so the state of gas delivery to the piezoelectric elements 63 may be managed.

Moreover, in the inkjet recording apparatus 10, as shown in FIG. 5, the protective sheet 220A is disposed between the drive circuit section 226Y of the inkjet head 20Y and the drive circuit section 226M of the inkjet head 20M, so these form one air flow passage. Accordingly, in the inkjet recording apparatus 10, the air is effectively utilized compared to a configuration where the protective sheet 220A is not disposed and the air released from the branch tube 296 (see FIG. 7) ends up being released into the atmosphere, so the efficiency with which the drive circuit sections 226 are cooled may be improved.

Figure 14A:
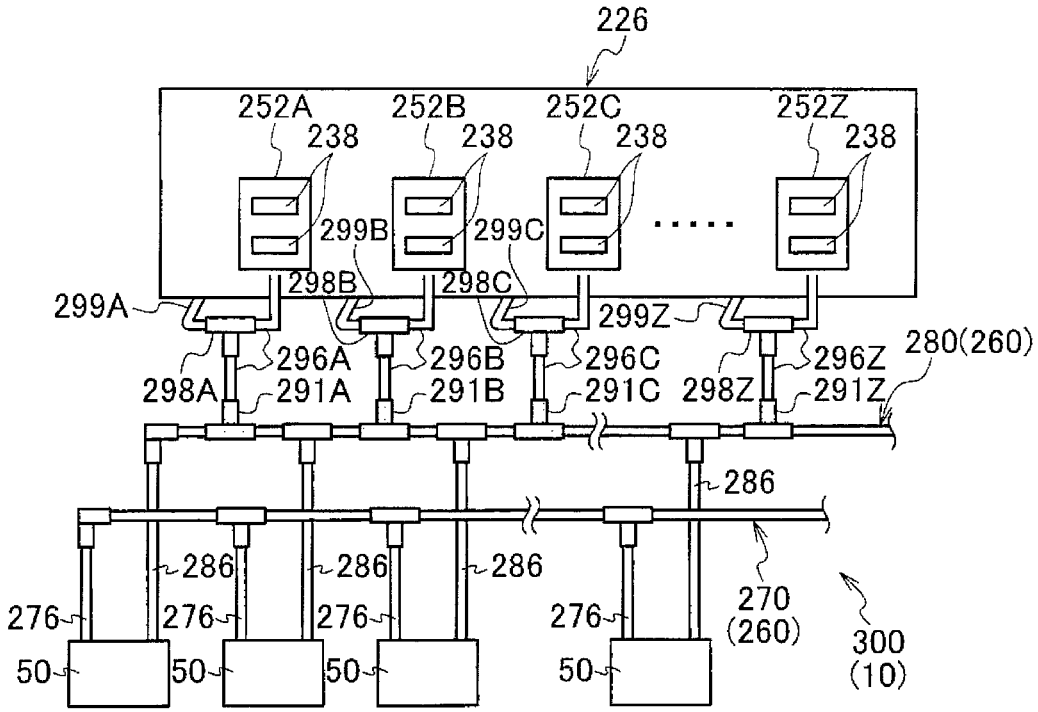
FIG. 14A is a schematic diagram showing the configuration of an air supply unit pertaining to an example modification of the first exemplary embodiment.
Figure 14B:
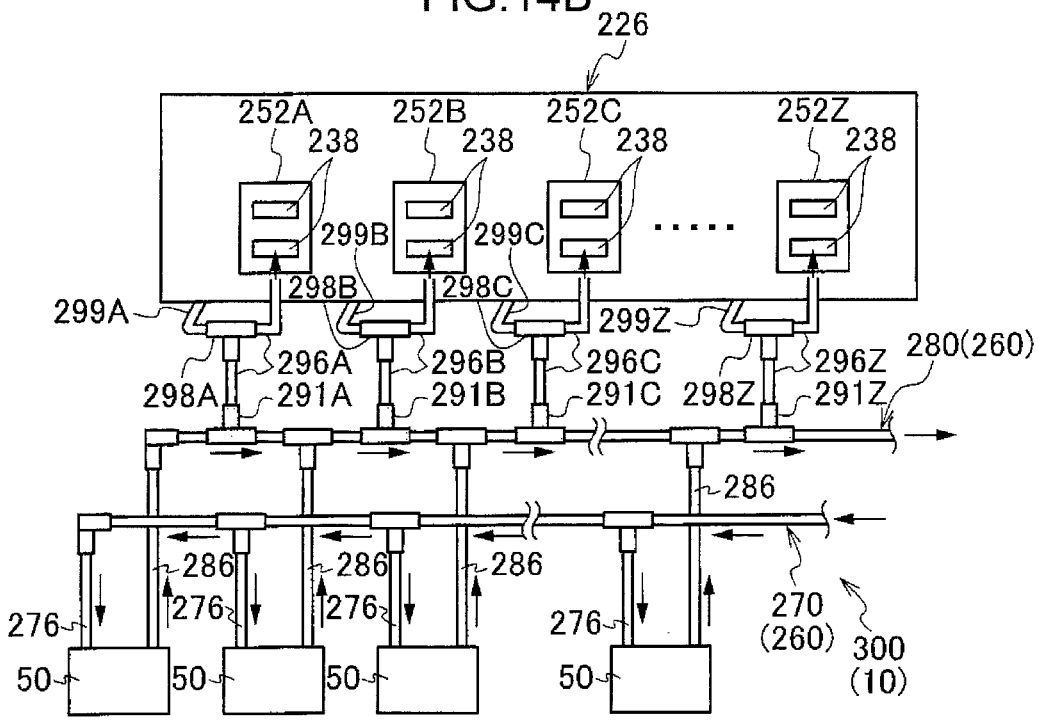
FIG. 14B is a schematic diagram showing a state in which the air supply unit pertaining to the example modification of the first exemplary embodiment is used to deliver air to head modules and plural heat sinks.

Furthermore, as an example modification of the inkjet recording apparatus 10 of the first exemplary embodiment, as shown in FIG. 14A and FIG. 14B, the plural driver ICs 238 may also be cooled in an inkjet head 300 disposed with plural heat sinks 252A, 252B, 252C, . . . , 252Z. In this case, duckbill valves 291A, 291B, 291C, . . . , 291Z, branch tubes 296A, 296B, 296C, . . . , 296Z, branch connectors 298A, 298B, 298C, . . . 298Z, and branch tubes 299A, 299B, 299C, . . . , 299Z are disposed in accordance with the positions of the heat sinks 252A, 252B, 252C, . . . , 252Z.

Second Exemplary Embodiment

Next, an example of a liquid droplet ejecting apparatus pertaining to a second exemplary embodiment of the present invention will be described.

The liquid droplet ejecting apparatus of the second exemplary embodiment has an inkjet head 310 from which the heat sinks 252 (see FIG. 7) have been removed instead of the inkjet head 20 in the inkjet recording apparatus 10 of the first exemplary embodiment described above. Other configurations are the same as those of the inkjet recording apparatus 10 of the first exemplary embodiment. For this reason, in the second exemplary embodiment, the apparatus will be referred to as the inkjet recording apparatus 10, and members and portions that are basically the same as those of the inkjet recording apparatus 10 of the first exemplary embodiment described above will be assigned the same reference signs as those in the first exemplary embodiment and description thereof will be omitted.

Figure 15:
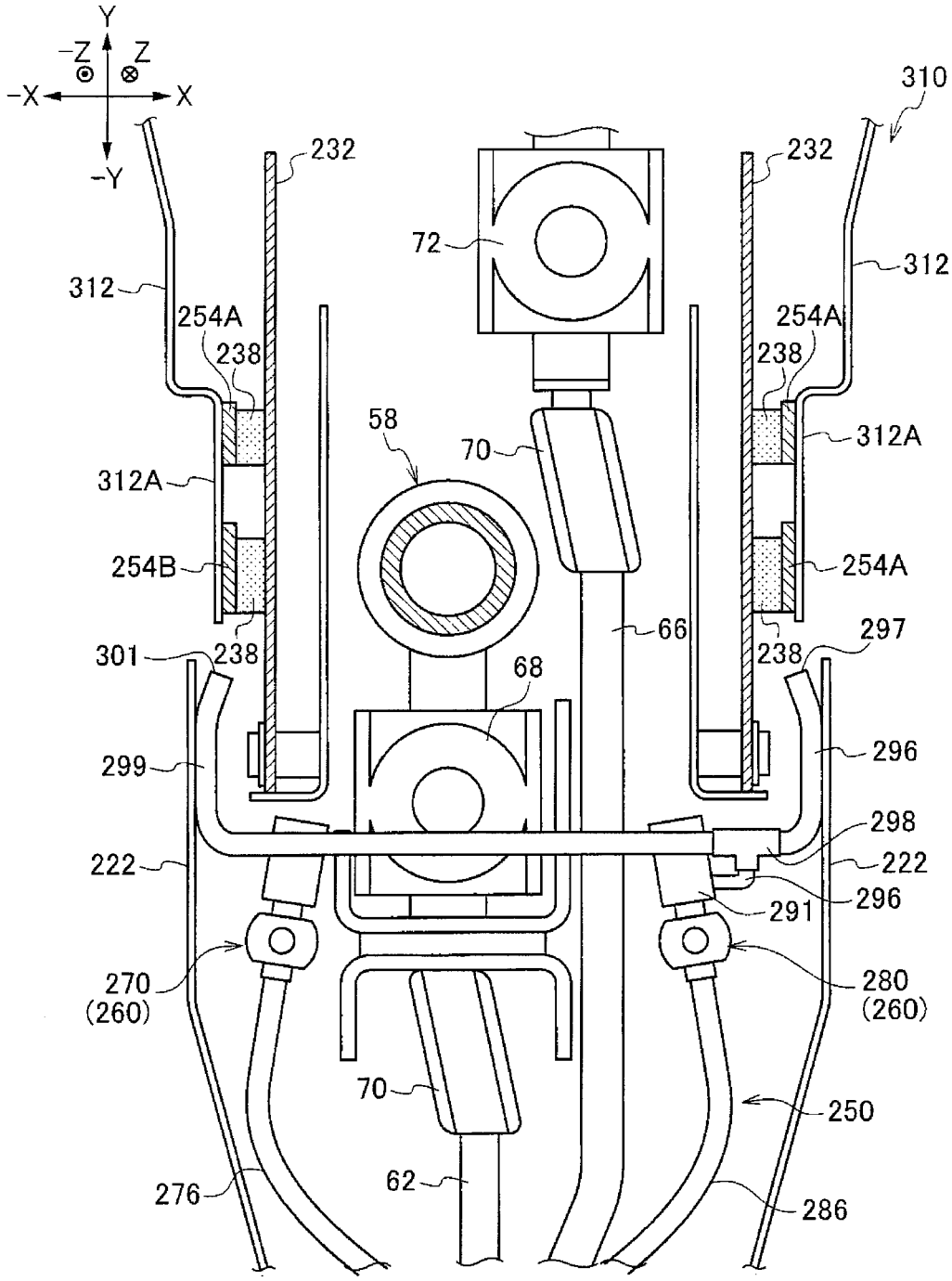
FIG. 15 is a longitudinal sectional view of an inkjet head pertaining to a second exemplary embodiment.

As shown in FIG. 15, the inkjet recording apparatus 10 of the second exemplary embodiment has the inkjet head 310. In the inkjet head 310, a head cover 312 is disposed in a position opposing the driver ICs 238. The head cover 222 is disposed surrounding the gas delivery unit 250 on the −Y direction side of the head cover 312.

The head cover 312 is made of aluminum, and an opposing portion 312A that opposes the driver ICs 238 is disposed on the −Y direction side end portion of the head cover 312. Additionally, the −X direction side surfaces of the thermally conductive sheets 254A are in contact with the driver ICs 238, and the X direction side surfaces of the thermally conductive sheets 254A are in contact with the opposing portion 312A. Accordingly, the heat of the driver ICs 238 is conducted via the thermally conductive sheets 254A to the head cover 312. Furthermore, in the inkjet head 310, the cooling openings 297 in the branch tubes 296 are disposed facing the driver ICs 238.

Figure 16A:
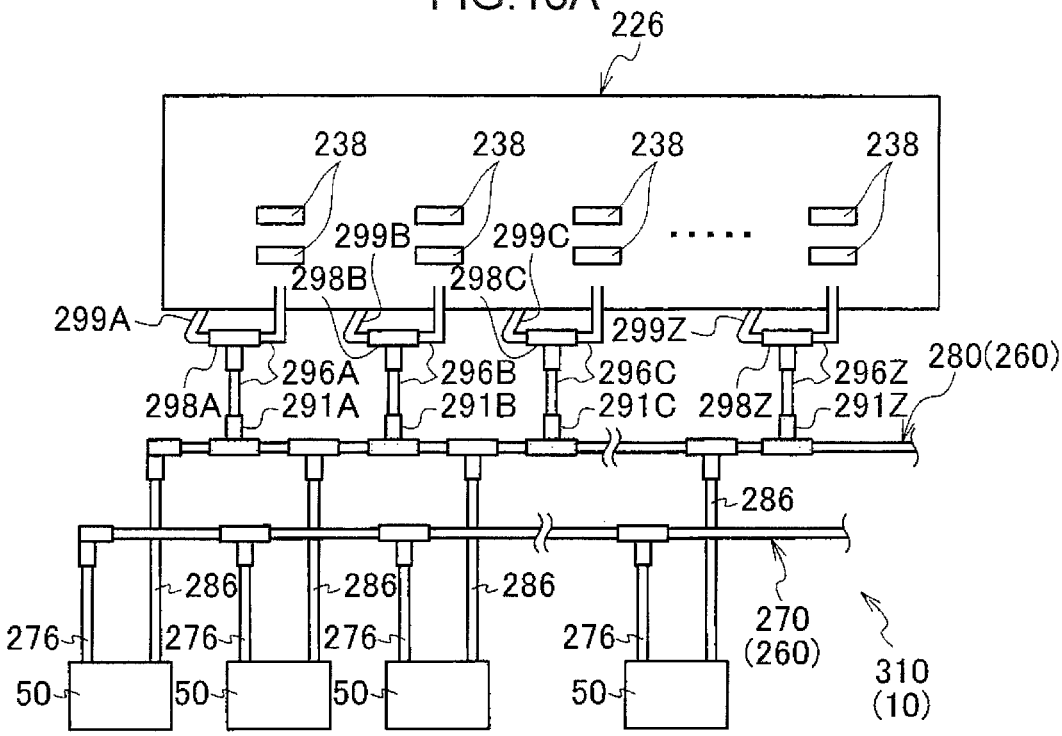
FIG. 16A is a schematic diagram showing the configuration of an air supply unit pertaining to the second exemplary embodiment.

Moreover, as shown in FIG. 16A, in the inkjet head 310, duckbill valves 291A, 291B, 291C, . . . , 291Z, branch tubes 296A, 296B, 296C, . . . , 296Z, branch connectors 298A, 298B, 298C, . . . , 298Z, and branch tubes 299A, 299B, 299C, . . . , 299Z are disposed in accordance with the positions of the plural driver ICs 238.

Next, the action of the second exemplary embodiment will be described.

Figure 16B:
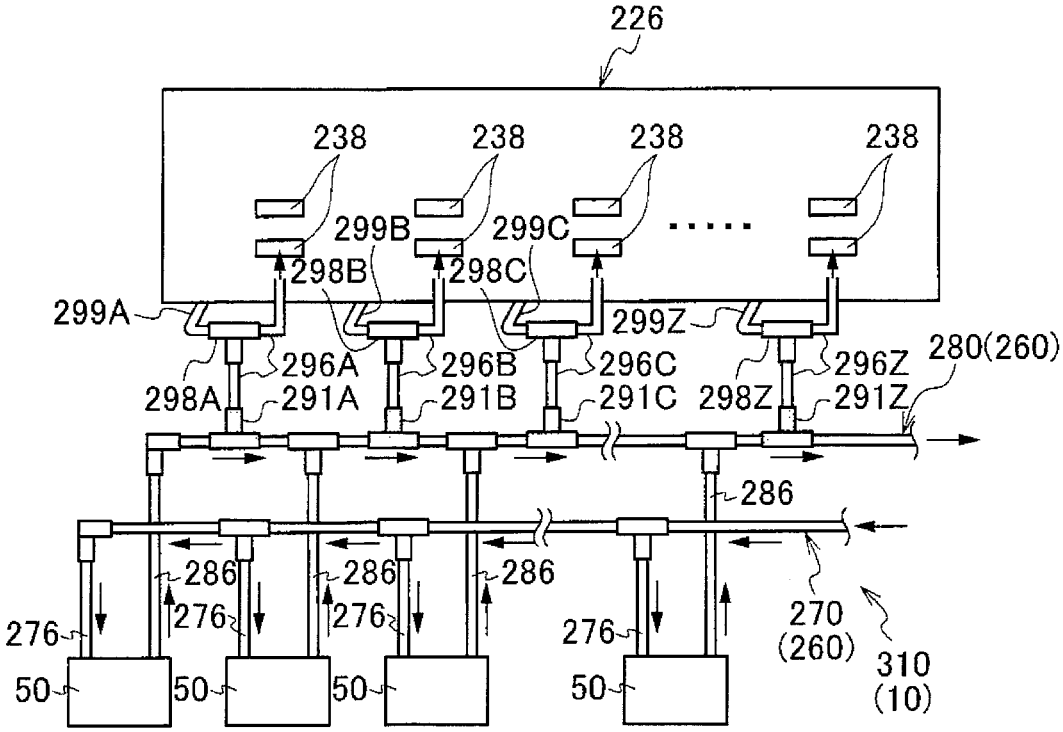
FIG. 16B is a schematic diagram showing a state in which the air supply unit pertaining to the second exemplary embodiment is used to deliver air to head modules and plural driver ICs.

As shown in FIG. 9, in a case in which the ventilation unit 262 starts operation (gas delivery), as shown in FIG. 16B, the dry air (indicated by the arrows) travels through the supply tube 270 and is supplied to the gas delivery chambers 57 (see FIG. 3) of the head modules 50. Then, the air (indicated by the arrows) that has absorbed moisture in the gas delivery chambers 57 travels through the recovery tube 280 and flows toward the ventilation unit 262 (see FIG. 9).

Next, some of the air flowing through the recovery tube 280 flows through the branch tubes 296A, 296B, 296C, . . . , 296Z as a result of the duckbill valves 291 being opened and is blown onto the plural driver ICs 238. Accordingly, the temperature of the plural driver ICs 238 drops. In this way, the drive circuit section 226 of the piezoelectric elements 63 (see FIG. 3) is cooled with a simple configuration by the dry air that has been delivered from the ventilation unit 262 that generates and delivers the dry air in order to dehumidify the environs of the piezoelectric elements 63.

Some of the air flowing through the branch tubes 296 flows through the branch tubes 299 and is blown onto the plural driver ICs 238 on the opposite side (the −X direction side in FIG. 15). Accordingly, the temperature of the plural driver ICs 238 on the opposite side drops.

Figure 17:
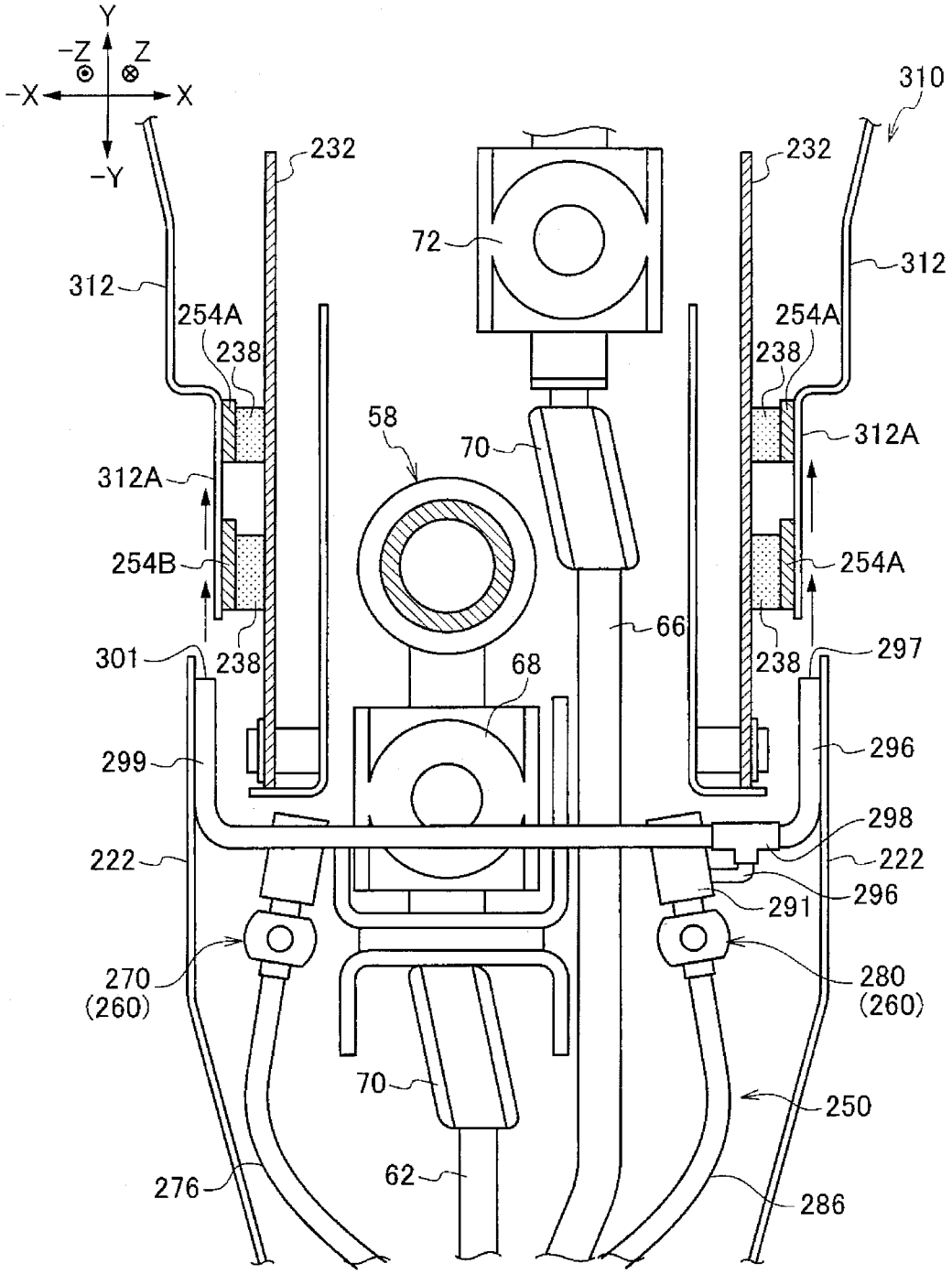
FIG. 17 is a longitudinal sectional view of an inkjet head pertaining to an example modification of the second exemplary embodiment.

As an example modification of the inkjet recording apparatus 10 of the second exemplary embodiment, as shown in FIG. 17, the cooling openings 297 in the branch tubes 296 and the cooling openings 301 in the branch tubes 299 may also be disposed facing the opposing portions 312A of the head cover 312. In this configuration, in a case in which the heat of the driver ICs 238 has been conducted via the thermally conductive sheets 254A to the opposing portions 312A, the opposing portions 312A are cooled by air that has been blown there onto from the branch tubes 296, so the driver ICs 238 are indirectly cooled.

Third Exemplary Embodiment

Next, an example of a liquid droplet ejecting apparatus pertaining to a third exemplary embodiment of the present invention will be described.

The liquid droplet ejecting apparatus of the third exemplary embodiment has an inkjet head 320 from which the heat sinks 252 (see FIG. 7) have been removed instead of the inkjet head 20 in the inkjet recording apparatus 10 of the first exemplary embodiment described above. Other configurations, except that of the head cover 312, are the same as those of the inkjet recording apparatus 10 of the first exemplary embodiment. For this reason, in the third exemplary embodiment, the apparatus will be referred to as the inkjet recording apparatus 10, and members and portions that are basically the same as those of the inkjet recording apparatus 10 of the first and second exemplary embodiments described above will be assigned the same reference signs as those in the first and second exemplary embodiments and description thereof will be omitted.

Figure 18:
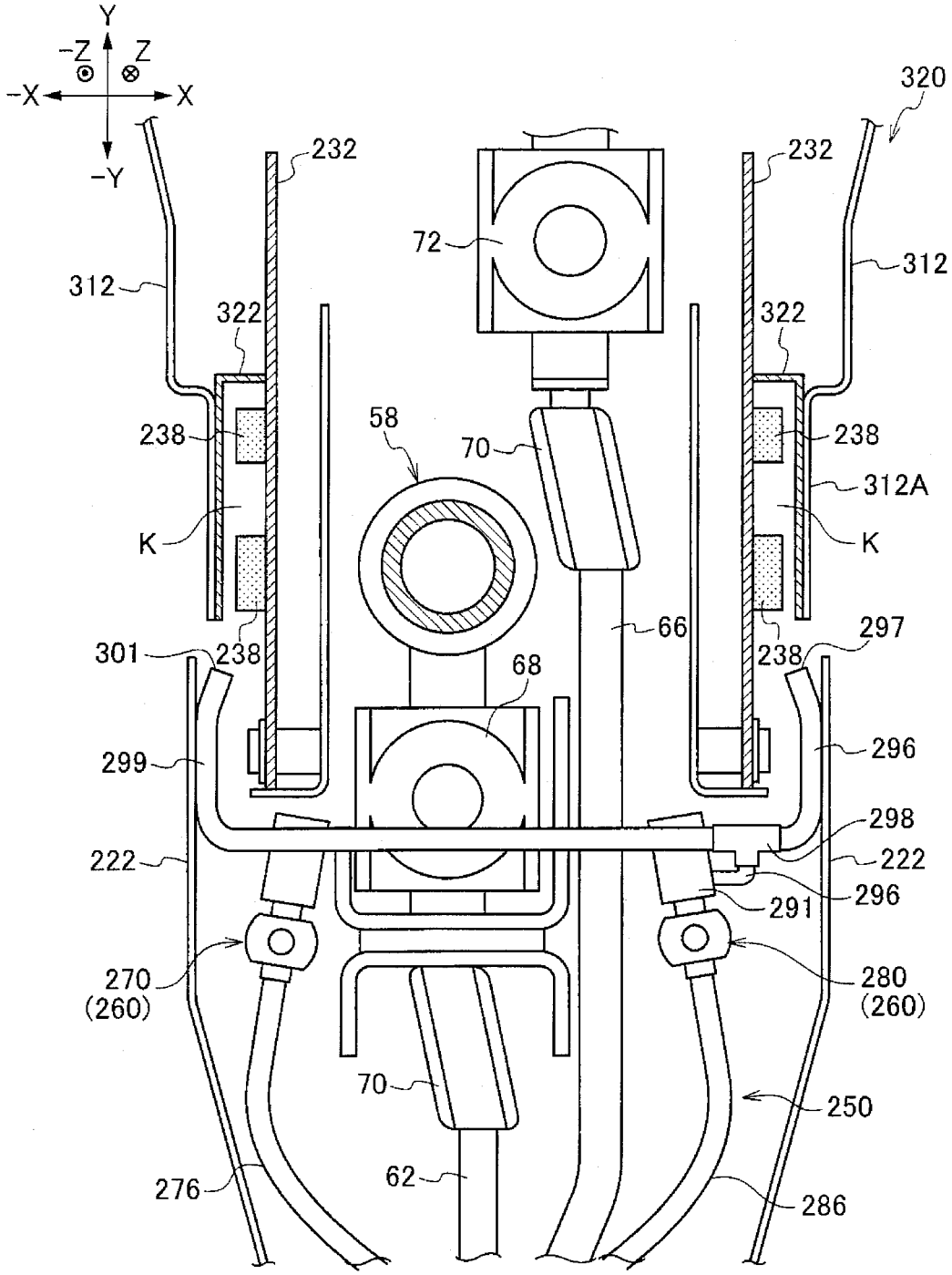
FIG. 18 is a longitudinal sectional view of an inkjet head pertaining to a third exemplary embodiment.
Figure 19A:
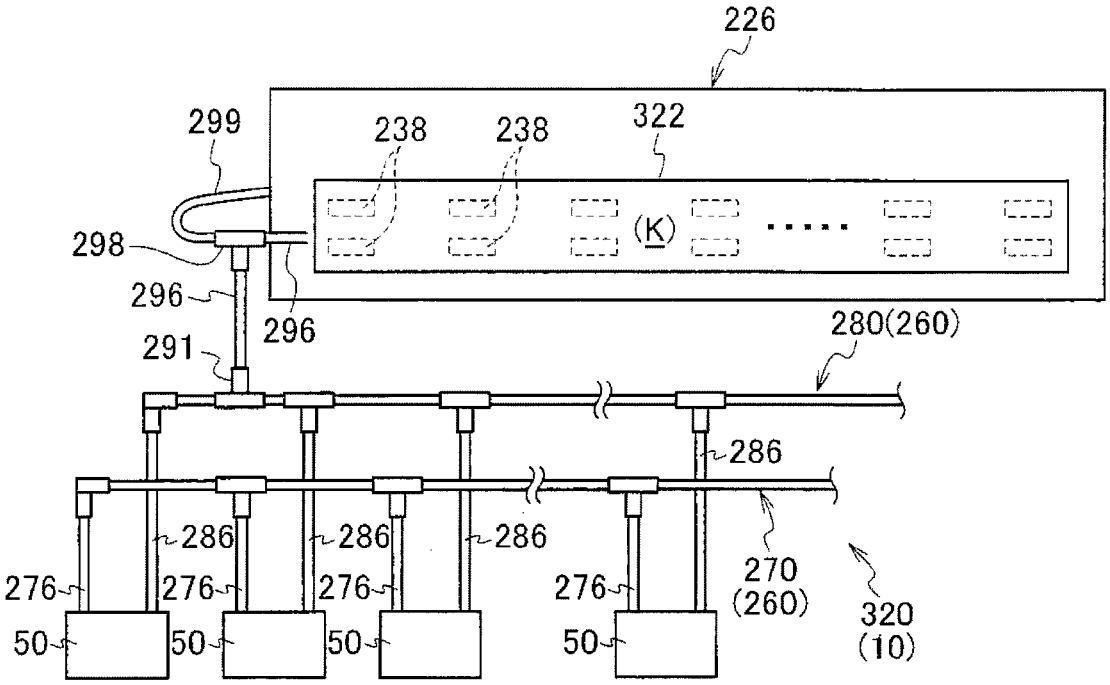
FIG. 19A is a schematic diagram showing the configuration of an air supply unit pertaining to the third exemplary embodiment.

As shown in FIG. 18 and FIG. 19A, the inkjet recording apparatus 10 of the third exemplary embodiment has the inkjet head 320. The inkjet head 320 has the head cover 312 (see FIG. 18), and a cover member 322 is disposed between the driver ICs 238 and the head cover 312 (the opposing portion 312A). The head cover 222 is disposed surrounding the gas delivery unit 250 on the −Y direction side of the head cover 312.

As shown in FIG. 18, the cover member 322 is made of aluminum, for example, with its X-Y sectional shape being shaped like an L when seen in the Z direction, and has one end fixed perpendicularly to the analog processing boards 232 and has another end disposed in a state in which it is bent in the −Y direction. Accordingly, the cover member 322 forms a gas delivery space K in which the Y direction side is closed and the −Y direction side is open in the X-Y section. The cover member 322 is not in contact with the driver ICs 238. Additionally, part of the cover member 322 is in contact with the opposing portion 312A.

Furthermore, in the inkjet head 320, the cooling opening 297 in the branch tube 296 and the cooling opening 301 in the branch tube 299 are disposed facing the driver ICs 238 and the gas delivery spaces K inside the cover members 322.

Next, the action of the third exemplary embodiment will be described.

Figure 19B:
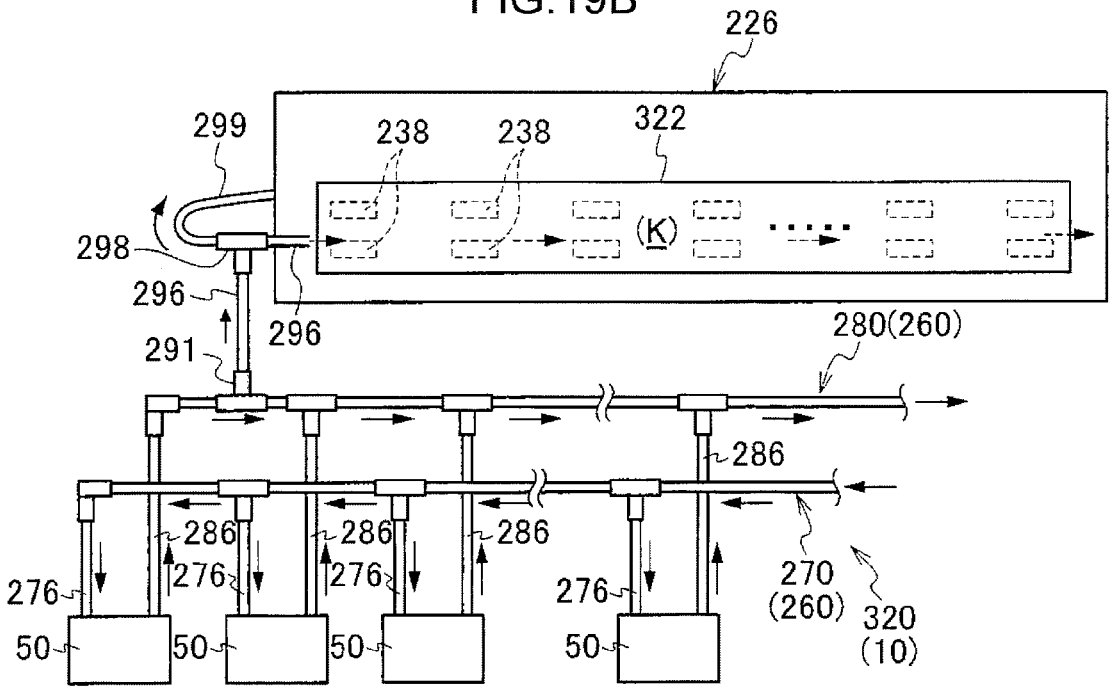
FIG. 19B is a schematic diagram showing a state in which the air supply unit pertaining to the third exemplary embodiment is used to deliver air to head modules and driver ICs.

As shown in FIG. 9, in a case in which the ventilation unit 262 starts operation (gas delivery), as shown in FIG. 19B, the dry air (indicated by the arrows) travels through the supply tube 270 and is supplied to the gas delivery chambers 57 (see FIG. 3) of the head modules 50. Then, the air (indicated by the arrows) that has absorbed moisture in the gas delivery chambers 57 travels through the recovery tube 280 and flows toward the ventilation unit 262 (see FIG. 9).

Next, some of the air flowing through the recovery tube 280 flows through the branch tube 296 as a result of the duckbill valve 291 being opened, travels through the open side (the −Y direction side) of the cover member 322, and is blown onto the plural driver ICs 238 on the X direction side (see FIG. 18). Additionally, some of the air flowing through the branch tube 296 flows through the branch tube 299, travels through the open side (the −Y direction side) of the cover member 322, and is blown onto the plural driver ICs 238 on the −X direction side.

Accordingly, the temperature of the plural driver ICs 238 drops. Here, the gas delivery space K inside the cover member 322 serves as an air flow passage, so the other driver ICs 238 are also cooled. In this way, in the inkjet recording apparatus 10, the ventilation unit 262 that generates and delivers the dry air in order to dehumidify the environs of the piezoelectric elements 63 also cools the driver ICs 238, so the drive circuit section 226 of the piezoelectric elements 63 (see FIG. 3) is cooled with a simple configuration.

Figure 20A:
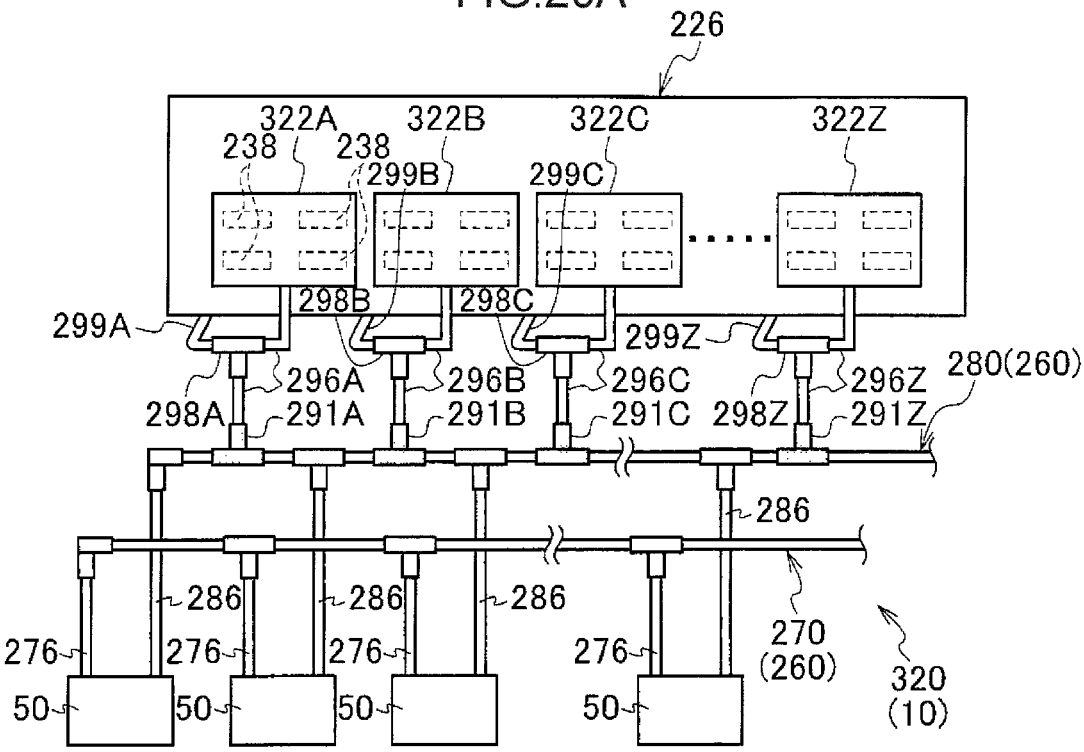
FIG. 20A is a schematic diagram showing the configuration of an air supply unit pertaining to an example modification of the third exemplary embodiment.
Figure 20B:
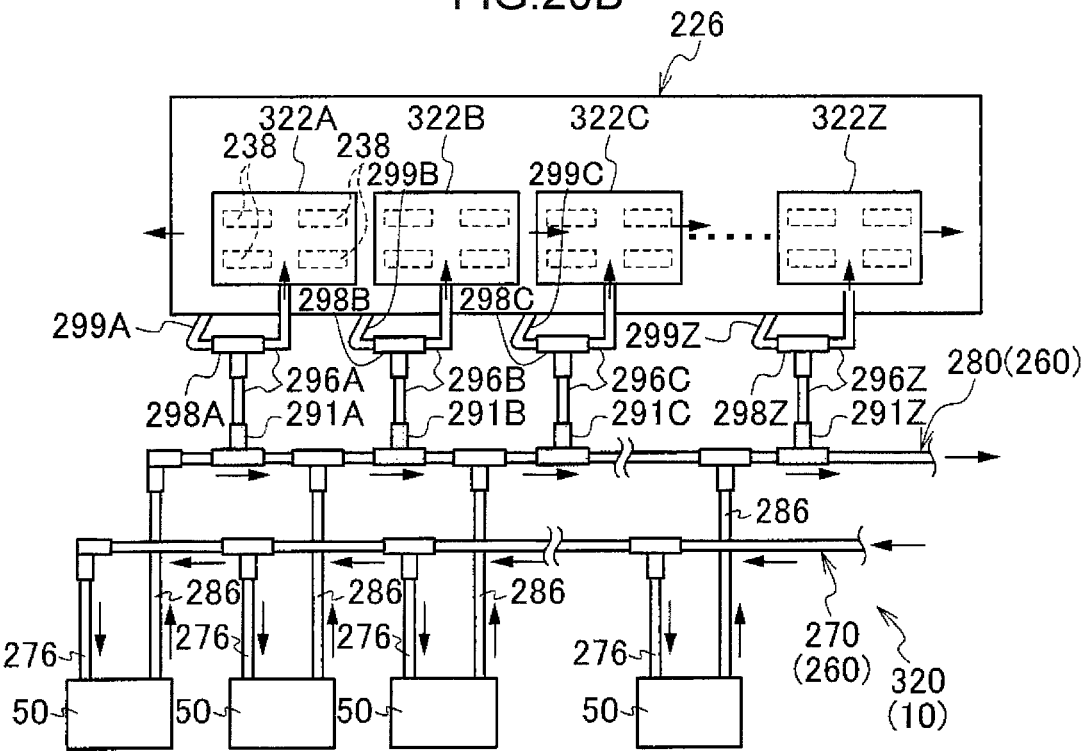
FIG. 20B is a schematic diagram showing a state in which the air supply unit pertaining to the example modification of the fourth exemplary embodiment is used to deliver air to head modules and driver ICs sectioned into plural blocks.

As an example modification of the inkjet recording apparatus 10 of the third exemplary embodiment, as shown in FIG. 20A and FIG. 20B, the plural driver ICs 238 may also be cooled by an inkjet head 320 disposed with plural cover members 322A, 322B, 322C, . . . , 322Z. In this case, duckbill valves 291A, 291B, 291C, . . . , 291Z, branch tubes 296A, 296B, 296C, . . . , 296Z, branch connectors 298A, 298B, 298C, . . . , 298Z, and branch tubes 299A, 299B, 299C, . . . , 299Z are disposed in accordance with the positions of the plural cover members 322A, 322B, 322C, . . . , 322Z.

Fourth Exemplary Embodiment

Next, an example of a liquid droplet ejecting apparatus pertaining to a fourth exemplary embodiment of the present invention will be described.

The liquid droplet ejecting apparatus of the fourth exemplary embodiment has an inkjet head 330 from which the branch connector 298 and the branch tube 299 (see FIG. 7) have been removed and in which a duckbill valve 293 and a branch tube 295 are disposed instead of the inkjet head 20 in the inkjet recording apparatus 10 of the first exemplary embodiment described above. Other configurations are the same as those of the inkjet recording apparatus 10 of the first exemplary embodiment. For this reason, in the fourth exemplary embodiment, the apparatus will be referred to as the inkjet recording apparatus 10, and members and portions that are basically the same as those of the inkjet recording apparatus 10 of the first, second, and third exemplary embodiments described above will be assigned the same reference signs as those in the first, second, and third exemplary embodiments and description thereof will be omitted.

Figure 21A:
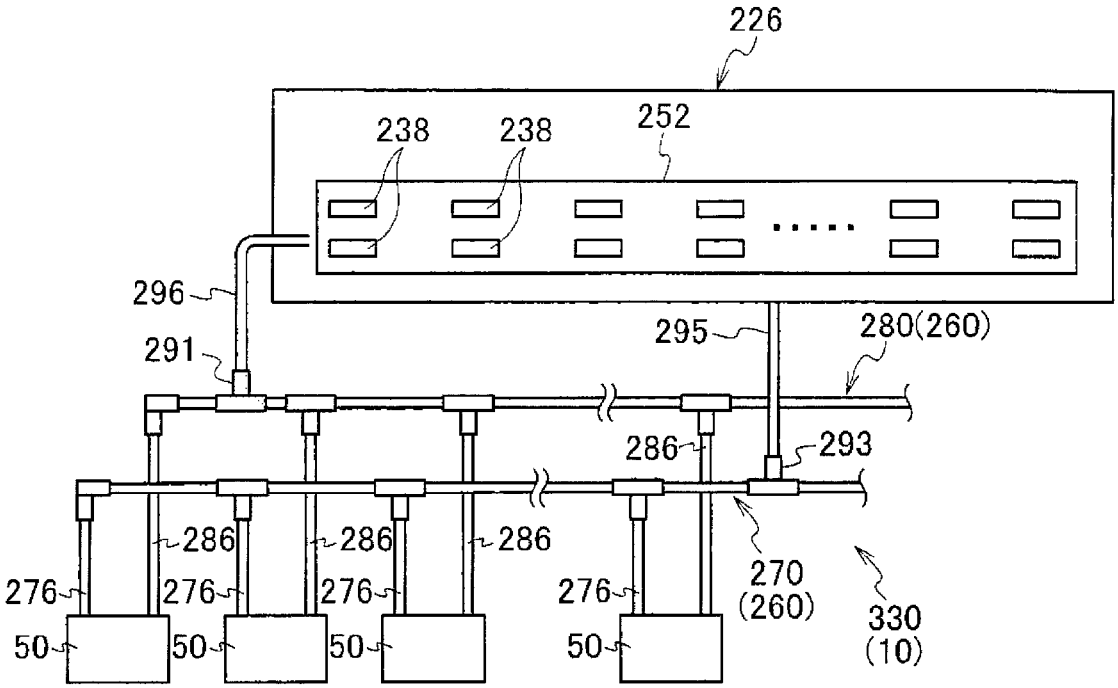
FIG. 21A is a schematic diagram showing the configuration of an air supply unit pertaining to a fourth exemplary embodiment.
Figure 22:
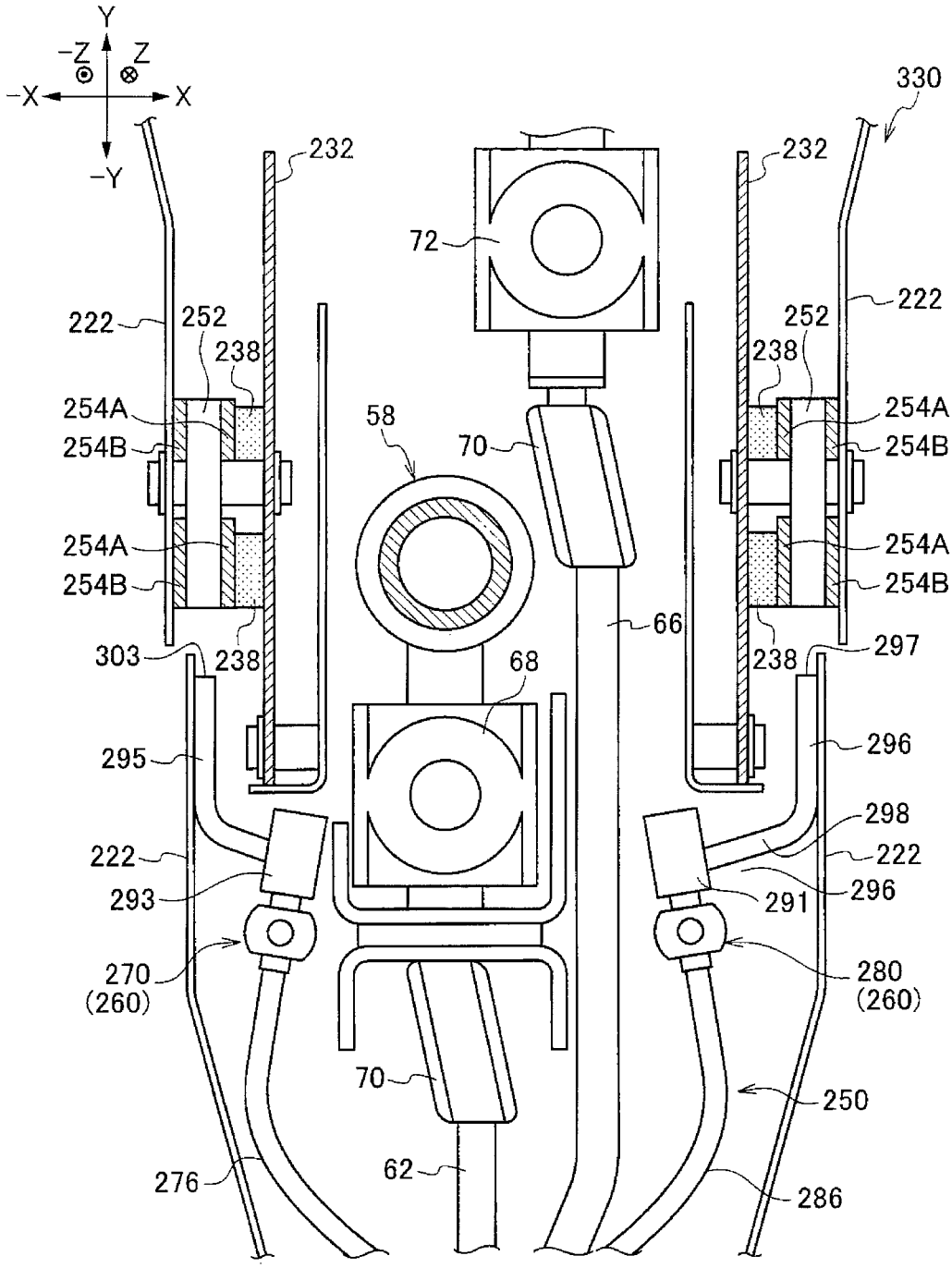
FIG. 22 is a longitudinal sectional view of an inkjet head pertaining to the fourth exemplary embodiment.

As shown in FIG. 21A and FIG. 22, the inkjet recording apparatus 10 of the fourth exemplary embodiment has the inkjet head 330. In the inkjet head 330, the duckbill valve 293 is disposed in the supply tube 270 on the upstream side of the supply side individual tube 276 on the most upstream side in the direction in which the dry air flows. Additionally, one end of a branch tube 295 is connected to the duckbill valve 293 on the side opposite the supply tube 270 side.

The duckbill valve 293 has the same configuration as that of the duckbill valve 291. Furthermore, the other end (a cooling opening 303) of the branch tube 295 is disposed facing the heat sink 252 on the opposite side (the −X direction side) of the heat sink 252 on the branch tube 296 side (the X direction side). As shown in FIG. 21A, the X direction positions of the duckbill valve 291 and the duckbill valve 293 are different, but in FIG. 22, the X direction positions of the duckbill valve 291 and the duckbill valve 293 are shown as being the same in order to show the arrangement in a way that is easier to understand.

Next, the action of the fourth exemplary embodiment will be described.

Figure 21B:
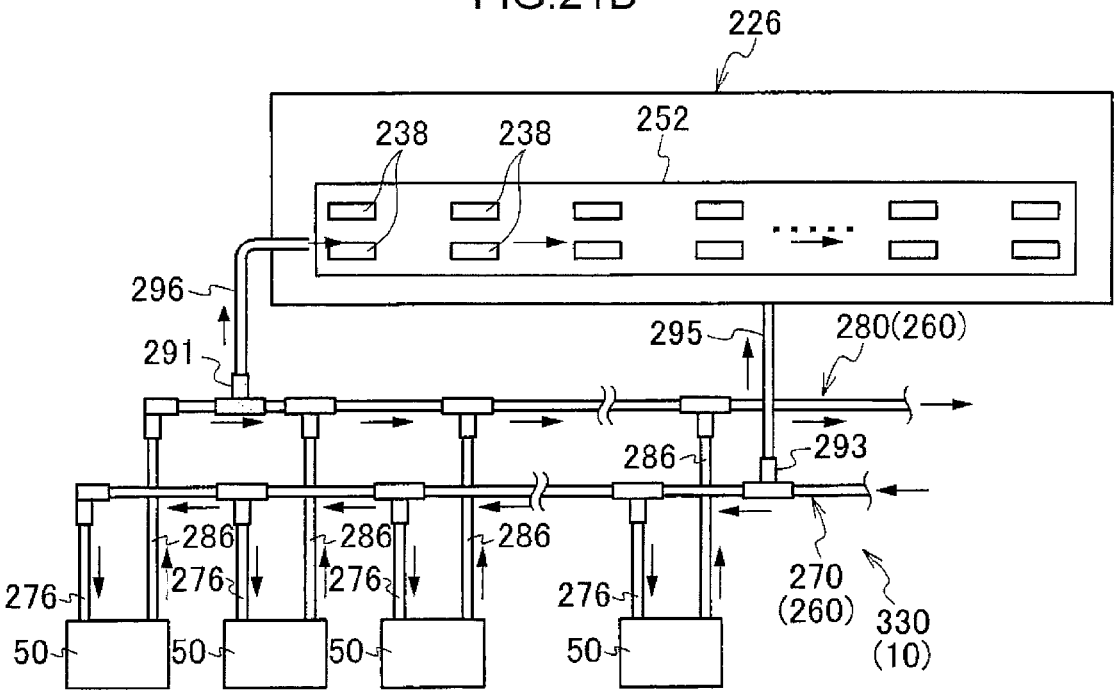
FIG. 21B is a schematic diagram showing a state in which the air supply unit pertaining to the fourth exemplary embodiment is used to deliver air to head modules and a heat sink.

As shown in FIG. 9, in a case in which the ventilation unit 262 starts operation (gas delivery), as shown in FIG. 21B, the dry air (indicated by the arrows) travels through the supply tube 270 and is supplied to the gas delivery chambers 57 (see FIG. 3) of the head modules 50. Then, the air (indicated by the arrows) that has absorbed moisture in the gas delivery chambers 57 travels through the recovery tube 280 and flows toward the ventilation unit 262 (see FIG. 9).

Next, some of the air flowing through the supply tube 270 flows through the branch tube 295 as a result of the duckbill valve 293 being opened and is blown onto the heat sink 252 on the −X direction side. Additionally, the heat sink 252 is cooled. Accordingly, the temperature of the plural driver ICs 238 on the −X direction side drops. Furthermore, some of the air flowing through the recovery tube 280 flows through the branch tube 296 as a result of the duckbill valve 291 being opened and is blown onto the heat sink 252 on the X direction side. Additionally, the heat sink 252 is cooled, and thus the temperature of the plural driver ICs 238 on the X direction side drops. In this way, the ventilation unit 262 that generates and delivers the dry air in order to dehumidify the environs of the piezoelectric elements 63 (see FIG. 3) also cools the driver ICs 238, so the drive circuit section 226 of the piezoelectric elements 63 is cooled with a simple configuration.

Figure 23A:
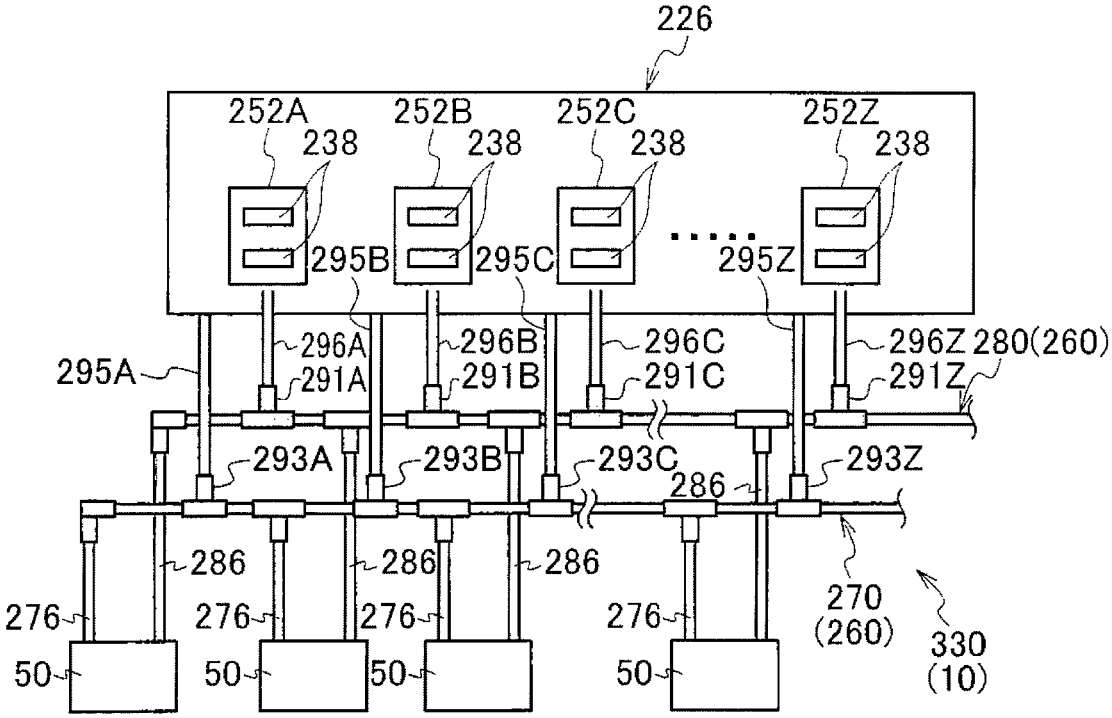
FIG. 23A is a schematic diagram showing the configuration of an air supply unit pertaining to an example modification of the fourth exemplary embodiment.
Figure 23B:
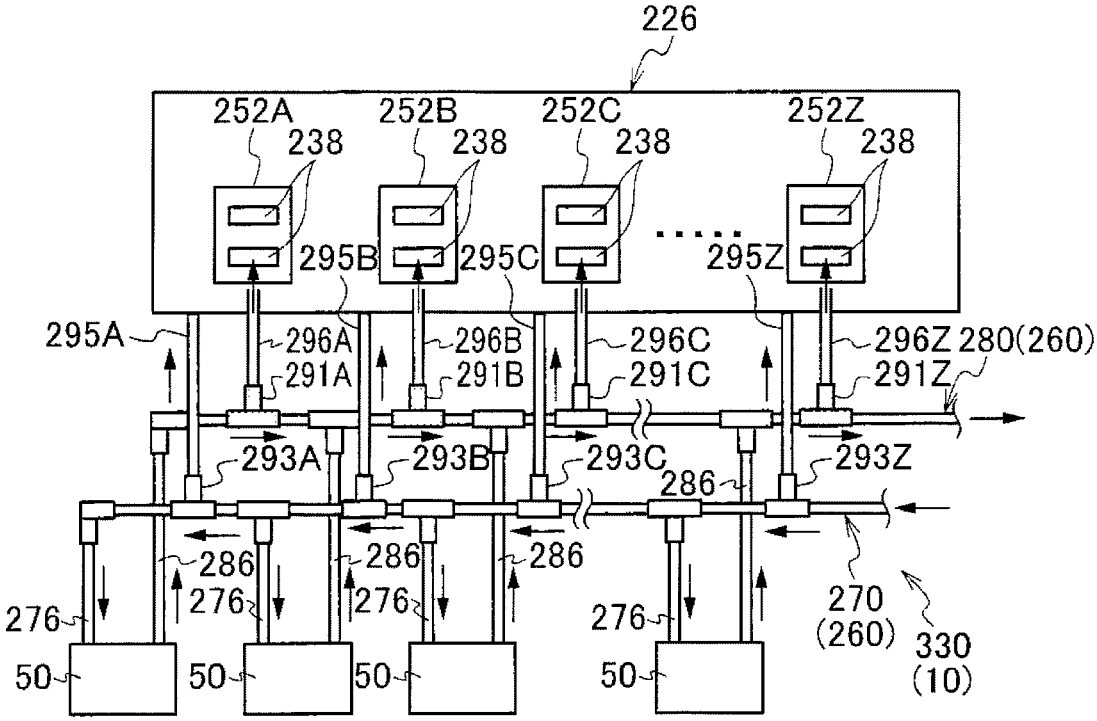
FIG. 23B is a schematic diagram showing a state in which the air supply unit pertaining to the example modification of the fourth exemplary embodiment is used to deliver air to head modules and heat sinks

As an example modification of the inkjet recording apparatus 10 of the fourth exemplary embodiment, as shown in FIG. 23A and FIG. 23B, the plural driver ICs 238 may also be cooled in an inkjet head 330 disposed with plural heat sinks 252A, 252B, 252C, . . . , 252Z. In this case, duckbill valves 291A, 291B, 291C, . . . 291Z, branch tubes 296A, 296B, 296C, . . . , 296Z, duckbill valves 293A, 293B, 293C, . . . , 293Z, and branch tubes 295A, 295B, 295C, . . . , 295Z are disposed in accordance with the positions of the heat sinks 252A, 252B, 252C, . . . , 252Z.

The present invention is not limited to the exemplary embodiments described above.

The numbers of the heat sink 252, the duckbill valve 291, the branch tube 296, and the cover member 322 can be freely set, singular or plural, provided that they are set in a range in which they can cool the driver ICs 238.

Furthermore, the gas delivery passage may also have a so-called single pass configuration in which its one end and its other end are not connected like the gas delivery passage 260.

Moreover, a filter dryer may also be used instead of the air dryer 265 inside the ventilation unit 262. In this configuration, high pressure becomes necessary, so a regulator is disposed on the downstream side of the air dryer.

The disclosure of Japanese Patent Application No. 2012-196481 is incorporated in its entirety herein by reference.

All publications, patent applications, and technical standards described in the present specification are incorporated herein by reference to the same extent as if each publication, patent application, or technical standard was specifically and individually indicated to be incorporated by reference.

What is claimed is:

1. A liquid droplet ejecting apparatus comprising:

a liquid droplet ejecting section that ejects liquid droplets by pressurizing a liquid using a piezoelectric element;

a drive section that drives the piezoelectric element;

a gas delivery section that delivers a dry gas;

a gas delivery passage in which the piezoelectric element is disposed and through which the gas that has been delivered from the gas delivery section flows;

a branch passage, which is disposed such that a side of the branch passage that is opposite a gas delivery passage side is facing the drive section, and which branches from the gas delivery passage and blows onto the drive section some of the gas that has been delivered from the gas delivery section; and a cutoff section, provided in the branch passage, that allows the gas to be delivered from the gas delivery passage to the branch passage, and that cuts off the flow of the gas from the branch passage to the gas delivery passage.

2. The liquid droplet ejecting apparatus according to claim 1, wherein the cutoff section is a one-way valve that is urged in a closing direction and is opened by a difference in pressure between the gas delivery passage and the branch passage in a case in which the gas delivery section starts gas delivery.

3. The liquid droplet ejecting apparatus according to claim 1, wherein:

one end and the other end of the gas delivery passage are connected to the gas delivery section, and the branch passage is configured such that the gas reaches from the one end to the other end of the gas delivery passage.

4. The liquid droplet ejecting apparatus according to claim 3, wherein:

a detecting section that detects a flow amount of the gas is provided in the gas delivery passage at a downstream side of the branch passage, and the gas delivery section delivers the gas such that the flow amount of the gas that has been detected by the detecting section becomes equal to or greater than a set amount.

5. The liquid droplet ejecting apparatus according to claim 1, wherein the branch passage branches from the gas delivery passage at a downstream side of the piezoelectric element.

6. The liquid droplet ejecting apparatus according to claim 1, wherein:

a plurality of each of the liquid droplet ejecting section and the drive section are provided, and a regulating member that regulates outflow of the gas that is delivered to the drive sections is provided between one of the plurality of drive sections and another of the plurality of drive sections.

* * * * *